US008042904B2

(12) United States Patent
Niihara et al.

(10) Patent No.: US 8,042,904 B2
(45) Date of Patent: Oct. 25, 2011

(54) IMAGE FORMING APPARATUS AND CARRIAGE

(75) Inventors: Takayuki Niihara, Kanagawa (JP); Kenichi Kawabata, Kanagawa (JP); Shinichiro Naruse, Kanagawa (JP); Mamoru Yorimoto, Tokyo (JP); Takumi Hagiwara, Aichi (JP); Tetsu Morino, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 507 days.

(21) Appl. No.: 12/326,607

(22) Filed: Dec. 2, 2008

(65) Prior Publication Data

US 2009/0148181 A1 Jun. 11, 2009

(30) Foreign Application Priority Data

Dec. 5, 2007 (JP) ..... 2007-314179

(51) Int. Cl.
*B41J 29/393* (2006.01)

(52) U.S. Cl. ..... 347/19

(58) Field of Classification Search ..... 347/19
See application file for complete search history.

(56) References Cited

U.S. PATENT DOCUMENTS

| | | | | |
|---|---|---|---|---|
| 5,451,990 | A * | 9/1995 | Sorenson et al. | 347/37 |
| 5,721,574 | A * | 2/1998 | Kubby | 347/7 |
| 2005/0146554 | A1 | 7/2005 | Asanuma et al. | |
| 2005/0194730 | A1 | 9/2005 | Nishida et al. | |
| 2006/0132574 | A1 | 6/2006 | Kawabata | |
| 2006/0146106 | A1 | 7/2006 | Naruse | |
| 2006/0209104 | A1 | 9/2006 | Naruse | |
| 2006/0268053 | A1 | 11/2006 | Naruse | |
| 2007/0035083 | A1 | 2/2007 | Kawabata | |
| 2007/0064032 | A1 | 3/2007 | Kawabata | |
| 2007/0120936 | A1 | 5/2007 | Kawabata | |
| 2007/0126787 | A1 | 6/2007 | Naruse | |
| 2008/0122890 | A1 | 5/2008 | Yorimoto | |
| 2008/0225066 | A1 | 9/2008 | Yorimoto et al. | |
| 2008/0225067 | A1 | 9/2008 | Morino et al. | |
| 2008/0225068 | A1 | 9/2008 | Morino et al. | |
| 2008/0225098 | A1 | 9/2008 | Hagiwara et al. | |
| 2008/0231649 | A1 | 9/2008 | Kawabata et al. | |

FOREIGN PATENT DOCUMENTS

| | | |
|---|---|---|
| JP | 9-226198 | 9/1997 |
| JP | 3397441 | 2/2003 |
| JP | 2006-264194 | 10/2006 |
| JP | 2007-121952 | 5/2007 |

* cited by examiner

*Primary Examiner* — Uyen Chau N Le
*Assistant Examiner* — Hoang Tran
(74) *Attorney, Agent, or Firm* — Cooper & Dunham LLP

(57) ABSTRACT

A side wall surface of a carriage is disclosed with two first projection parts and a second projection part that define the inclination of a reflective optical sensor in its vertical direction. The two first projection parts are arranged at the same height position with a detection surface as a reference, and the second projection part is arranged at a position higher than the first projection parts with the detection surface as the reference. The second projection part has a first part higher in position from the side wall surface of the carriage than the first projection parts and has a second part lower in position than the first part. The second part has a screw hole into which a clamping member for fixing the reflective optical sensor to the second part is tightened.

11 Claims, 35 Drawing Sheets

IMAGE FORMING APPARATUS AND CARRIAGE

BACKGROUND OF THE INVENTION

1. Field of the Invention

The present invention generally relates to image forming apparatuses and carriages and, in particular, to a carriage in which an image forming section is installed and an image forming apparatus having the carriage.

2. Description of the Related Art

As an image forming apparatus such as a printer, a facsimile machine, a copier, and a multi-task machine having plural such functions, there is employed, e.g., a liquid ejection apparatus including a recording head composed of liquid ejection heads (liquid droplet ejection heads) that eject the liquid droplets of recording liquid (liquid) so as to perform image formation. During image formation (used synonymously with recording, printing, and imaging), this liquid ejection apparatus causes liquid (hereinafter referred to as ink) to adhere to a medium, while transferring the medium (hereinafter referred also to as a sheet, but it does not limit the material; also it is used synonymously with a medium to be recorded, a recording medium, a transfer member, a recording paper, etc.).

Note that in the present invention, the "image forming apparatus" refers to an apparatus that ejects liquid onto a medium such as a paper, a thread, a fiber, a fabric, leather, metal, a plastic, glass, wood, and a ceramic so as to perform the image formation. Furthermore, the "image formation" refers to forming on the medium not only meaningful images such as characters and graphics, but also meaningless images such as patterns (i.e., liquid droplets are just ejected and shot). That is, the image forming apparatus refers also to a textile printing apparatus or an apparatus that forms a metal wiring. Furthermore, the "ink" is not particularly limited so long as it is capable of performing the image formation.

When the image forming apparatus of such a liquid droplet ejection type causes a carriage, on which the recording heads that eject liquid droplets are mounted, to reciprocate so as to print the images of ruled lines bi-directionally, the deviation of the ruled lines is likely to occur in forward and backward directions. Furthermore, when printed images in different colors are superposed one on another, slurring is likely to occur.

Generally, in an ink jet recording apparatus or the like, a test chart for adjusting the deviation of shooting positions is output so that users select and input an optimum value. Accordingly, ejection timing is adjusted based on the input results. However, users have their own way of viewing the test chart and are unaccustomed to the operations. Therefore, they are likely to erroneously input data. As a result, an adjustment problem may be adversely incurred.

In view of the above problem, Patent Document 1 describes an image forming apparatus that prints test patterns on a holding and conveying member, such as a conveying belt and a medium, and scans the test patterns with an optical sensor provided in a carriage to correct the deviation of shooting positions.

Patent Document 1: JP-A-2006-264194

Note that examples of image forming apparatuses including an electrophotographic type using the optical sensor are as follows.

Patent Document 2: JP-A-9-226198

Patent Document 3: JP-B2-3397441

Patent Document 4: JP-A-2007-121952

However, when the test patterns formed on the conveying belt are scanned by the optical sensor provided in the carriage, it is difficult to scan the test patterns accurately because their color difference is small depending, for example, on the combination of the color of the conveying belt and that of the ink. In this case, it is necessary to provide a configuration such as a light source whose wavelength is varied for each color so as to detect the colors accurately. In practical sense, however, the test patterns formed on the conveying belt cannot be accurately scanned.

If there is employed, as the conveying belt, an electrostatic one composed of an insulating layer on its front surface and an intermediate resistive layer on its rear surface and incorporating carbon to provide the intermediate resistive layer with a conductive property, the color of the electrostatic belt is black in appearance. Therefore, when the test patterns are detected only by the reflection of the colors, it is difficult to distinguish black ink from the electrostatic belt. As a result, the patterns cannot be detected.

Thus, the present inventor has proposed a method for dealing with the above problem. According to this method, patterns composed of independent ink droplets are formed on the surface of the conveying belt in advance. Then, short-wavelength light is applied to the ink droplets. Taking advantage of the characteristics in which the ink droplets are formed into a semispherical shape, the attenuated amount of regular reflection light is detected according to the formed patterns. As a result, the positions of the patterns and positional deviation can be accurately detected.

Typically, when the conveying surface (called a "detection surface") of a medium to be recorded, such as the front surface of the medium to be recorded and the conveying belt, is detected using a reflective optical sensor, it turns out that light-receiving sensitivity when the reflective optical sensor is arranged to be slightly inclined is greater than that when the optical sensor applies injection light in a direction perpendicular to the detection surface and receives its reflection light.

On the other hand, the carriage is generally fabricated by injection molding using resin. However, in consideration of the cutting out of the carriage, the injection molding is performed so that a cutting-out direction is perpendicular to the carriage. Therefore, it is necessary to provide a simple structure for mounting and arranging the optical sensor on the side wall surface of the carriage.

SUMMARY OF THE INVENTION

The present invention has been made in view of the above problems and may enable a reflective optical sensor to be mounted on the side wall surface of a carriage fabricated by injection molding using resin with a simple structure at an angle slightly inclined relative to a direction perpendicular to a detection surface.

According to one aspect of the present invention, there is provided an image forming apparatus including a carriage containing an image forming section for forming an image on a medium to be recorded and is moved to scan; and an optical sensor that is mounted on a side wall surface of the carriage in a main scanning direction and detects the medium to be recorded or a conveying surface of the medium to be recorded. In the image forming apparatus, the side wall surface of the carriage is provided with at least two first projection parts and a second projection part that define the inclination of the optical sensor in a vertical direction. The at least two first projection parts are arranged at a same height position with the conveying surface of the medium to be recorded as a reference, and the second projection part is arranged at a position higher than the first projection parts. The second projection part has a first part higher in position from the side wall surface of the carriage than the first projection parts and has a second part lower in position than the first part, and the second part has a screw hole in which a clamping member for fixing the optical sensor is attached.

Preferably, the first part of the second projection part may be shaped like an arch composed of a string and an arc, parallel to the side wall surface of the carriage, and provided at a position farther from the first projection parts than the screw hole.

Preferably, distances from the second projection part to the first projection parts may be equal.

Preferably, the optical sensor may have a plate-shaped holding member that supports a sensor part including a light-emitting section and a light-receiving section, the holding member having a part away from the sensor part at which the second projection part is fixed.

Preferably, the sensor part supported by the holding member may come in contact with the first projection parts at both its side parts.

Preferably, the first projection parts with which the holding member comes in contact may be shaped like one of "R"s and flat surfaces. Furthermore, tip end parts of the first projection parts with which the holding member comes in contact may be semispherical. Furthermore, tip end parts of the first projection parts with which the holding member comes in contact may be tapered. Furthermore, the holding member may have through-holes in which the tip end parts of the first projection parts partially fit.

Preferably, the first part of the second projection part may be tapered rather than be parallel to the side wall surface of the carriage and provided farther from the first projection parts than the screw hole.

According to another aspect of the present invention, there is provided a carriage containing an image forming section for forming an image on a medium to be recorded and is moved to scan. In the carriage, the side wall surface of the carriage in a main scanning direction is provided with at least two first projection parts and a second projection part that define the inclination of an optical sensor in a vertical direction. The optical sensor detects one of a medium to be recorded and a conveying surface of the medium to be recorded. At least the two first projection parts are arranged at the same height position with the conveying surface of the medium to be recorded as a reference and the second projection part is arranged at a position higher than the first projection parts. The second projection part has a first part higher in position from the side wall surface of the carriage than the first projection parts and has a second part lower in position than the first part. The second part has a screw hole in which a clamping member for fixing the optical sensor is attached.

In the image forming apparatus according to embodiments of the present invention, the side wall surface of the carriage is provided with at least two the first projection parts and the second projection part that define the inclination of the optical sensor in its vertical direction. At least the two first projection parts are arranged at the same height position with the conveying surface of a medium to be recorded as the reference, and the second projection part is arranged at a position higher than the first projection parts. The second projection part has the first part higher in position from the side wall surface of the carriage than the first projection parts and has the second part lower in position than the first part. Moreover, the second part has the screw hole into which the clamping member for fixing the optical sensor to the second part is tightened. Accordingly, with a simple configuration, it is possible to mount the reflective optical sensor on the side wall surface of the carriage, which is fabricated by injection molding using resin, so as to be slightly inclined relative to a direction perpendicular to the detection surface.

Other objects, features and advantages of the present invention will become more apparent from the following detailed description when read in conjunction with the accompanying drawings.

DETAILED DESCRIPTION OF THE PREFERRED EMBODIMENTS

Figure 1:
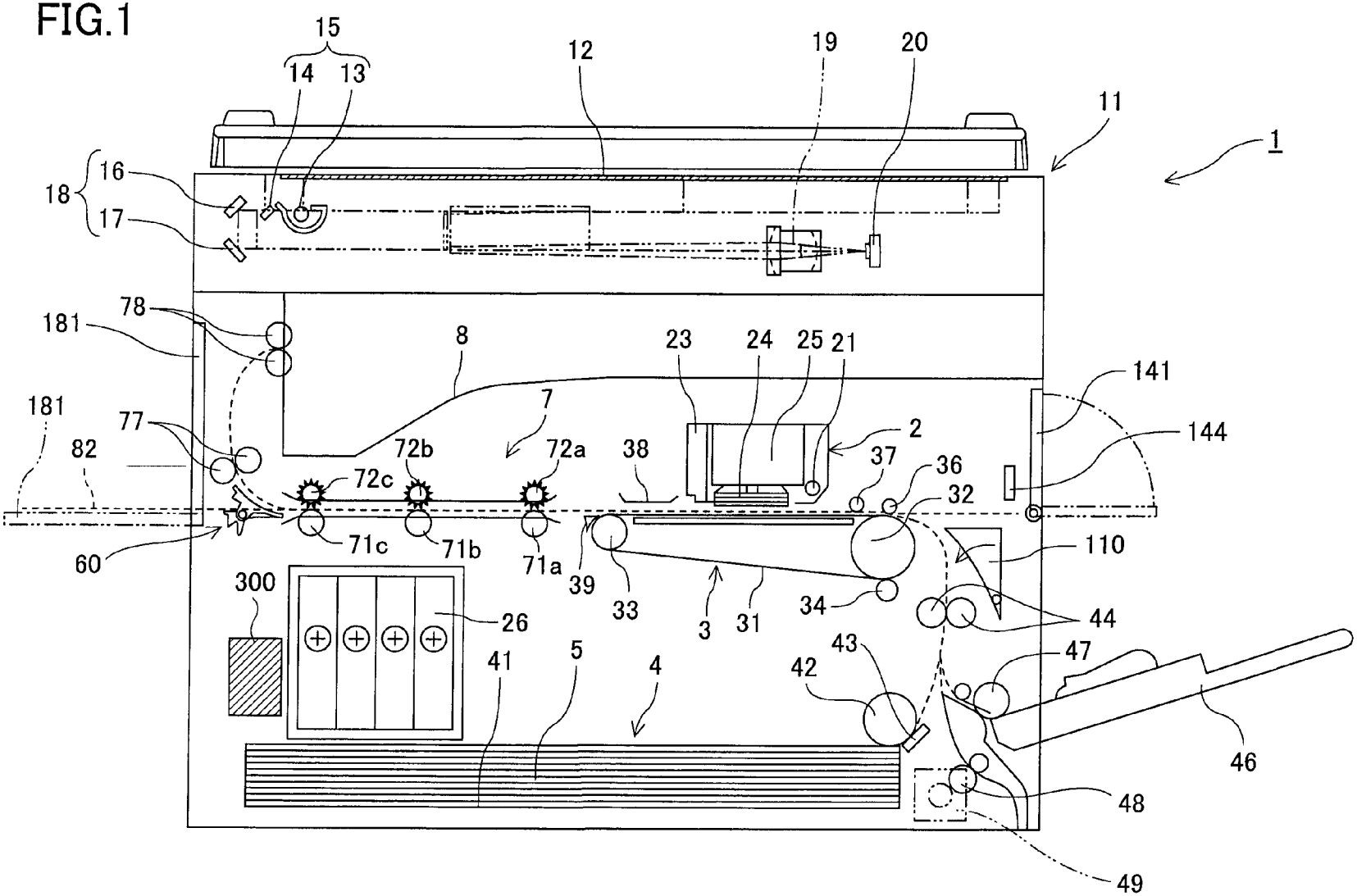
FIG. 1 is a schematic view showing an entire configuration of an example of an image forming apparatus to which an embodiment of the present invention is applied.
Figure 2:
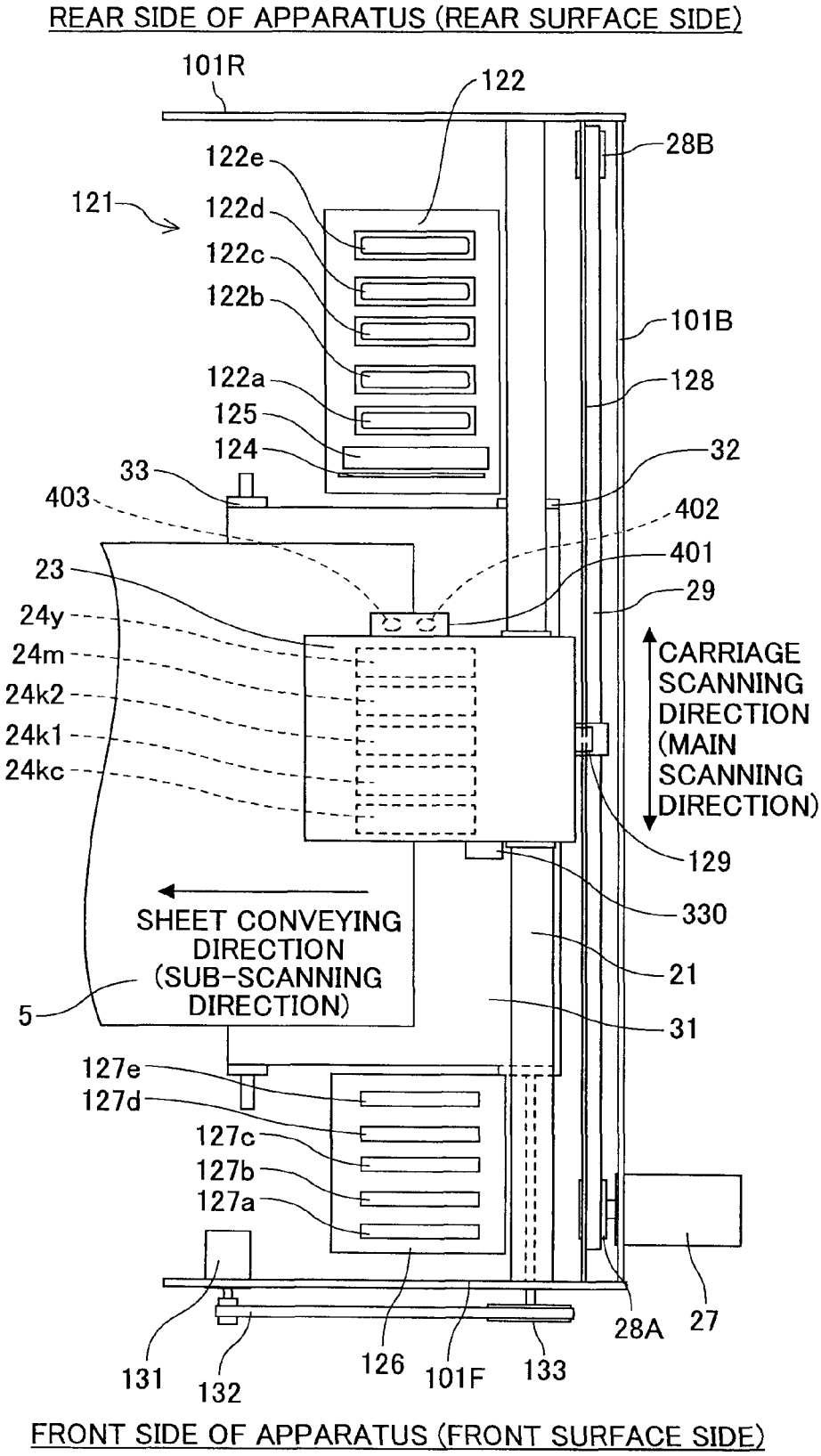
FIG. 2 is a plan view showing an image forming section and a sub-scanning conveying section of the image forming apparatus.
Figure 3:
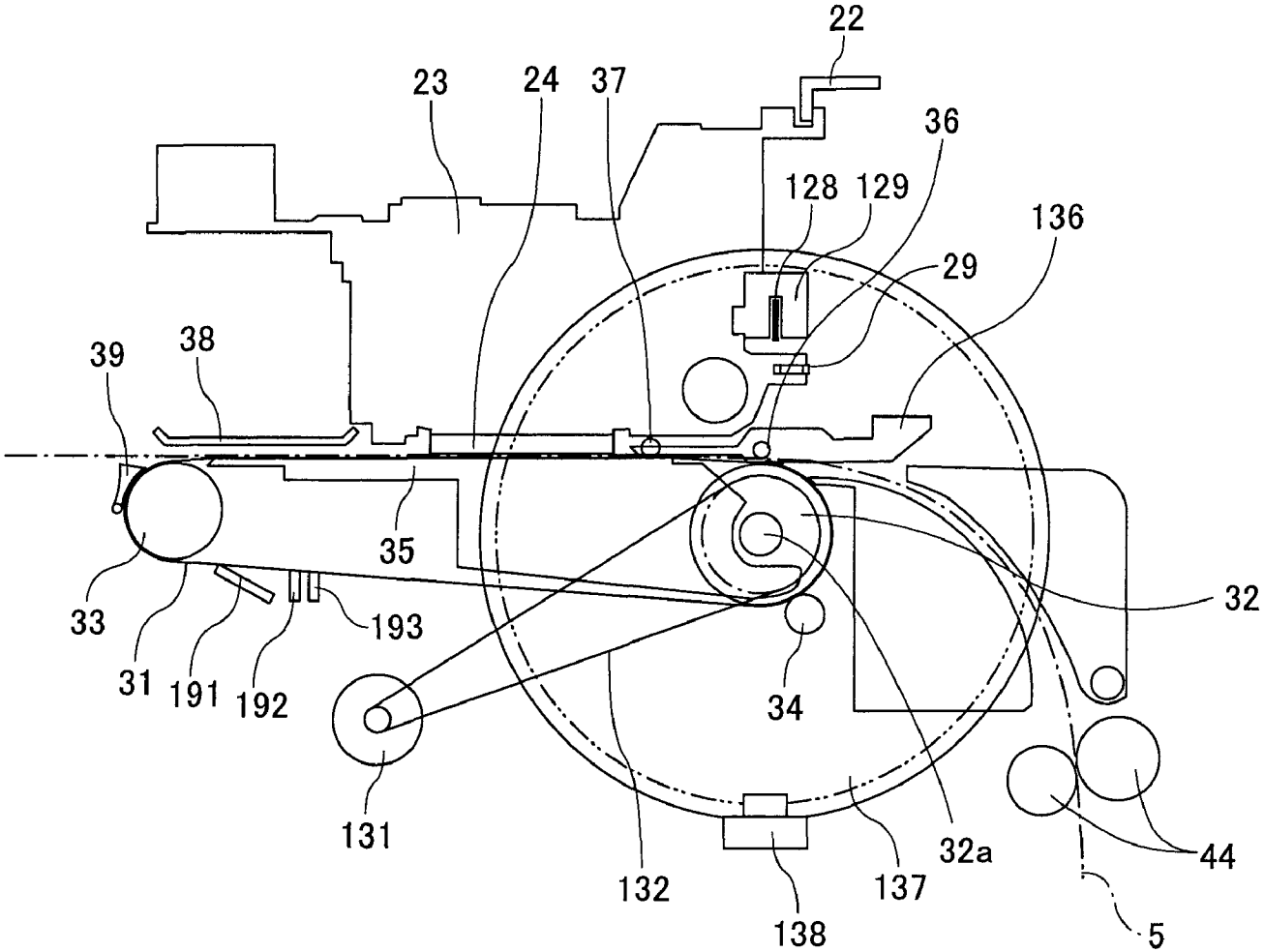
FIG. 3 is a side schematic view showing the image forming section and the sub-scanning conveying section.

Next, referring to the accompanying drawings, a description is made of embodiments of the present invention. FIGS. 1 through 5 describe a general outline of an example of an image forming apparatus according to the embodiments of the present invention that performs a method for correcting the deviation of shooting positions of liquid droplets. Note that FIGS. 1, 2, and 3 are a schematic view showing an entire configuration of the image forming apparatus, a plan view showing an image forming section and a sub-scanning conveying section of the image forming apparatus, and a side schematic view showing the image forming section and the sub-scanning conveying section, respectively.

The image forming apparatus includes an image forming section 2 that forms images while conveying a sheet, a sub-scanning conveying section 3 that conveys the sheet, and the like inside (in the housing of) an apparatus main body 1. In the image forming apparatus, a sheet 5 is individually fed from a sheet feeding section 4 including a sheet feeding cassette provided at the bottom of the apparatus main body 1. After the image forming section 2 ejects liquid droplets onto the sheet 5 to form (record) desired images when the sheet 5 is conveyed at the position opposing the image forming section 2 by the sub-scanning conveying section 3, the sheet 5 is discharged onto a sheet discharging tray 8 formed on the upper surface of the apparatus main body 1 through a sheet discharge conveying section 7.

Furthermore, the image forming apparatus further includes, as an input system for image data (print data) formed by the image forming section 2, an image scanning section (scanner section) 11 placed at the upper part of the apparatus main body 1 above the sheet discharging tray 8 so as to scan images. In the image scanning section 11, a scanning optical system 15 including an illumination source 13 and a mirror 14 and a scanning optical system 18 including mirrors 16 and 17 are moved to scan a document image placed on a contact glass 12. The scanned image of the document is read as an image signal by an image scanning element 20 arranged in the backward position of a lens 19. The read image signal is digitized and subjected to image processing, thus allowing the print data subjected to the image processing to be printed.

As shown in FIG. 2, in the image forming section 2 of the image forming apparatus, a cantilevered carriage 23, is movably held in the main scanning direction by a guide rod 21 and a guide rail (not shown) and moved to scan in the main scanning direction by a main scanning motor 27 through a timing belt 29 wound around a drive pulley 28A and a driven pulley 28B.

As shown in FIG. 2, in the image forming section 2 of the image forming apparatus, the carriage 23 is movably held in the main scanning, direction by the lateral carriage guide (guide rod) 21 provided between a front plate 101F and a rear plate 101R and a guide stay 22 provided in a rear stay 101B and is moved to scan in the main scanning direction by the main scanning motor 27 through the timing belt 29 suspended between the drive pulley 28A and the driven pulley 28B.

The carriage 23 has five liquid droplet ejection heads mounted on it including recording heads 24*k*1 and 24*k*2 consisting of two liquid droplet ejection heads for ejecting black (K) ink and recording heads 24*c*, 24*m*, and 24*y* (referred to as a "recording head 24" when colors are not differentiated from each other or when the recording heads are given a numeric name) consisting of liquid droplet ejection heads for ejecting cyan (C) ink, magenta (M) ink, and yellow (Y) ink, respectively. The image forming apparatus is a shuttle-type that moves the carriage 23 in the main scanning direction and causes liquid droplets to be ejected from the recording head 24 so as to form images when the sheet 5 is fed in the sheet conveying direction (sub-scanning direction) by the sub-scanning conveying section 3.

Furthermore, the carriage 23 has sub-tanks 25 mounted on it to supply required colors of recording liquid to the corresponding recording heads 24. On the other hand, as shown in FIG. 1, ink cartridges 26 as recording liquid cartridges storing black (K) ink, cyan (C) ink, magenta (M) ink, and yellow (Y) ink, can be detachably loaded into a cartridge loading section 26A from the front side of the apparatus main body 1, and ink (recording liquid) is supplied from the colors of ink cartridges 26 to replenish the corresponding colors of the sub-tanks 25 through tubes (not shown). Note that the black ink is supplied from the one ink cartridge 26 to two sub-tanks 25.

Examples of the recording head 24 include a so-called piezoelectric type in which a piezoelectric element as a pressure generator (actuator) that increases the pressure of ink in an ink channel (pressure generating chamber) is used to deform a vibration plate forming the wall surface of the ink channel to change the volume of the ink channel, thereby ejecting ink droplets. Furthermore, a so-called thermal type can also be used in which the pressure generated by heating ink in an ink channel with a heating element to produce air bubbles is used to eject ink droplets. Furthermore, an electrostatic type can also be used in which the electrostatic force generated between a vibrating plate and an electrode is used to deform the vibrating plate where the vibrating plate forming the wall surface of an ink channel and the electrode are arranged to oppose each other to change the volume of the ink channel, thereby ejecting ink droplets.

Furthermore, a linear scale 128 having slits is extended between the front and rear plates 101F and 101R along the main scanning direction of the carriage 23, and an encoder sensor 129 composed of a transmissive photosensor that detects the slits formed in the linear scale 128 is provided in the carriage 23. The linear scale 128 and the encoder sensor 129 constitute a linear encoder that detects the movement of the carriage 23.

Furthermore, on one side surface of the carriage 23 is mounted a pattern scanning sensor 401 as an optical sensor that is composed of a reflective photosensor including a light emitting element (section) and a light receiving element (section) for detecting (adjustment patterns) the deviation of shooting positions according to the embodiments of the present invention. As described below, this pattern scanning sensor 401 scans an adjustment pattern for detecting the deviation of shooting positions formed on the conveying belt 31. In addition, on the other side surface of the carriage 23 is mounted a sheet member detecting sensor (tip end detecting sensor) 330 as a sheet member detecting section for detecting the tip end of a member to be conveyed.

Moreover, a maintenance and recovery mechanism (apparatus) 121 that maintains and recovers the operational capability of the nozzles of the recording head 24 is arranged in a non-printing area on one side in the scanning direction of the carriage 23. The maintenance and recovery mechanism 121 includes one suction cap 122*a* serving also as a moisturizing item and four moisturizing caps 122*b* through 122*e* as cap members that cap corresponding nozzle surfaces 24*a* of the five recording heads 24, a wiper blade 124 as a wiping member that wipes off the nozzle surface 24*a* of the recording head 24, and an idle ejection receiver 125 for idle ejection. Furthermore, an idle ejection receiver 126 for idle ejection is arranged in a non-printing area on the other side in the scanning direction of the carriage 23. The idle ejection receiver 126 has openings 127*a* through 127*e* formed in it.

As shown in FIG. 3, the sub-scanning conveying section 3 includes an endless conveying belt 31 wound around a conveying roller 32 as a drive roller and a driven roller 33 as a tension roller to change the conveying direction of the sheet 5 fed from the lower side of the apparatus main body 1 by approximately 90 degrees so as to convey the sheet 5 in the direction opposing the image forming section 2; a charging roller 34 as a charging section to which a high voltage alternating current is applied from a high-voltage power supply to charge the front surface of the conveying belt 31; a guide member 35 that guides the conveying belt 31 at the area opposing the image forming section 2; pressure rollers 36 and 37 that are rotatably held by a holding member 136 and press the sheet 5 against the conveying belt 31 at the position opposing the conveying roller 32; a guide plate 38 that presses the top surface of the sheet 5 where images are formed by the image forming section 2; and a separating claw 39 that separates the sheet 5 where images are formed by the image forming section 2 from the conveying belt 31.

Figure 4:
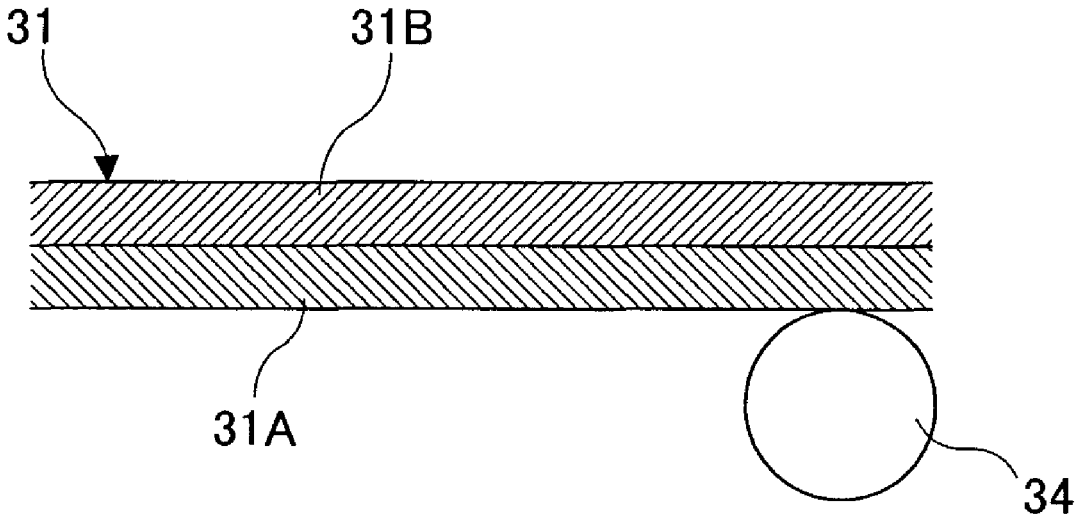
FIG. 4 is a cross-sectional view showing an example of a conveying belt.

The conveying belt 31 is configured to rotate in the sheet conveying direction (sub-scanning direction) when the conveying roller 32 is rotated by a sub-scanning motor 131 that is a DC brushless motor through a timing belt 132 and a timing roller 133. As shown in FIG. 4, the conveying belt 31 has a double layered structure composed of a front layer 31A serving as a sheet attraction surface made of a pure resin material such as ETFE in which resistance control is not effected and a rear layer (such as an intermediate resistance layer and a ground layer) 31B made of the same material as the front layer and in which resistance control is effected by carbon. However, the conveying belt 31 is not limited to this in its structure, and it may have a single or a three or more layered structure.

Between the driven roller 33 and the charging roller 34, there are provided a Mylar sheet (paper dust removing section) 191, a cleaning brush 192, and an electricity removing brush 193 from the upstream side in the moving direction of the conveying belt 31. The Mylar sheet 191 serves as a cleaning section for removing paper dust or the like adhering onto the front surface of the conveying belt 31 and is made of a PET film as a contact member that contacts the front surface of the conveying belt 31, the cleaning brush 192 has a brush shape and contacts the surface of the conveying belt 31, and the electricity removing brush 193 removes charges on the front surface of the conveying belt 31.

Moreover, a high-resolution code wheel 137 is attached to a shaft 32*a* of the conveying roller 32, and an encoder sensor 138 composed of a transmissive photosensor that detects a slit 137*a* formed in the code wheel 137 is provided. The code wheel 137 and the encoder sensor 138 constitute a rotary encoder.

The sheet feeding section 4 includes a sheet feeding cassette 41 that can be inserted in and extracted from the apparatus main body 1 and serves as a storage section for storing multiple sheets 5 in a stacked manner, a sheet feeding roller 42 and a friction pad 43 that individually separate and feed the sheets 5 of the sheet feeding cassette 41, and a pair of resist rollers 44 that resist the fed sheet 5.

Furthermore, the sheet feeding section 4 includes a manual feeding tray 46 that stores multiple sheets 5 in a stacked manner, a manual feeding roller 47 used to individually feed a sheet 5 from the manual feeding tray 46, and a vertically conveying roller 48 used to convey the sheet 5 fed from a sheet feeding cassette or a double-sided unit optionally attached on the bottom side of the apparatus main body 1. Such members as the sheet feeding roller 42, the resist rollers 44, the manual feeding roller 47, and the vertically conveying roller 48, which are used to feed the sheet 5 to the sub-scanning conveying section 3, are driven to rotate by a sheet feeding motor (driving section) 49 composed of a HB stepping motor through an electromagnetic clutch (not shown).

The sheet discharge conveying section 7 includes three conveying rollers 71*a*, 71*b*, and 71*c* (referred to as a "conveying roller 71" as a whole) that convey the sheet 5 separated by the separating claws 39 of the sub-scanning conveying section 3; spurs 72*a*, 72*b*, and 72*c* (referred to as a "spur 72" as a whole) opposing the conveying rollers 71*a*, 71*b*, and 71*c*; and a pair of sheet inversion rollers 77 and 78 that inverts the sheet 5 to be fed to the sheet discharging tray 8 face-down.

As shown in FIG. 1, a manual sheet feeding tray 141 is provided in an openable/closable manner (in a manner capable of falling open) on one lateral side of the apparatus main body 1 to feed a sheet manually. At the time of feeding the sheet manually, the manual sheet feeding tray 141 is opened to the position indicated by an imaginary line in FIG. 1. The sheet 5 manually fed from the manual sheet feeding tray 141 can be guided on the top surface of the guide plate 110 and linearly inserted between the conveying roller 32 and the pressure roller 36 of the sub-scanning conveying section 3 as it is.

On the other hand, a straight sheet discharging tray 181 is provided in an openable/closable manner (in a manner capable of falling open) on the other lateral side so that the sheet 5 where images are formed is discharged straight out and face-up. By opening the straight sheet discharging tray 181, it is possible to intuitively discharge the sheet 5 fed from the sheet discharge conveying section 7 to the straight sheet discharging tray 181.

Figure 5:
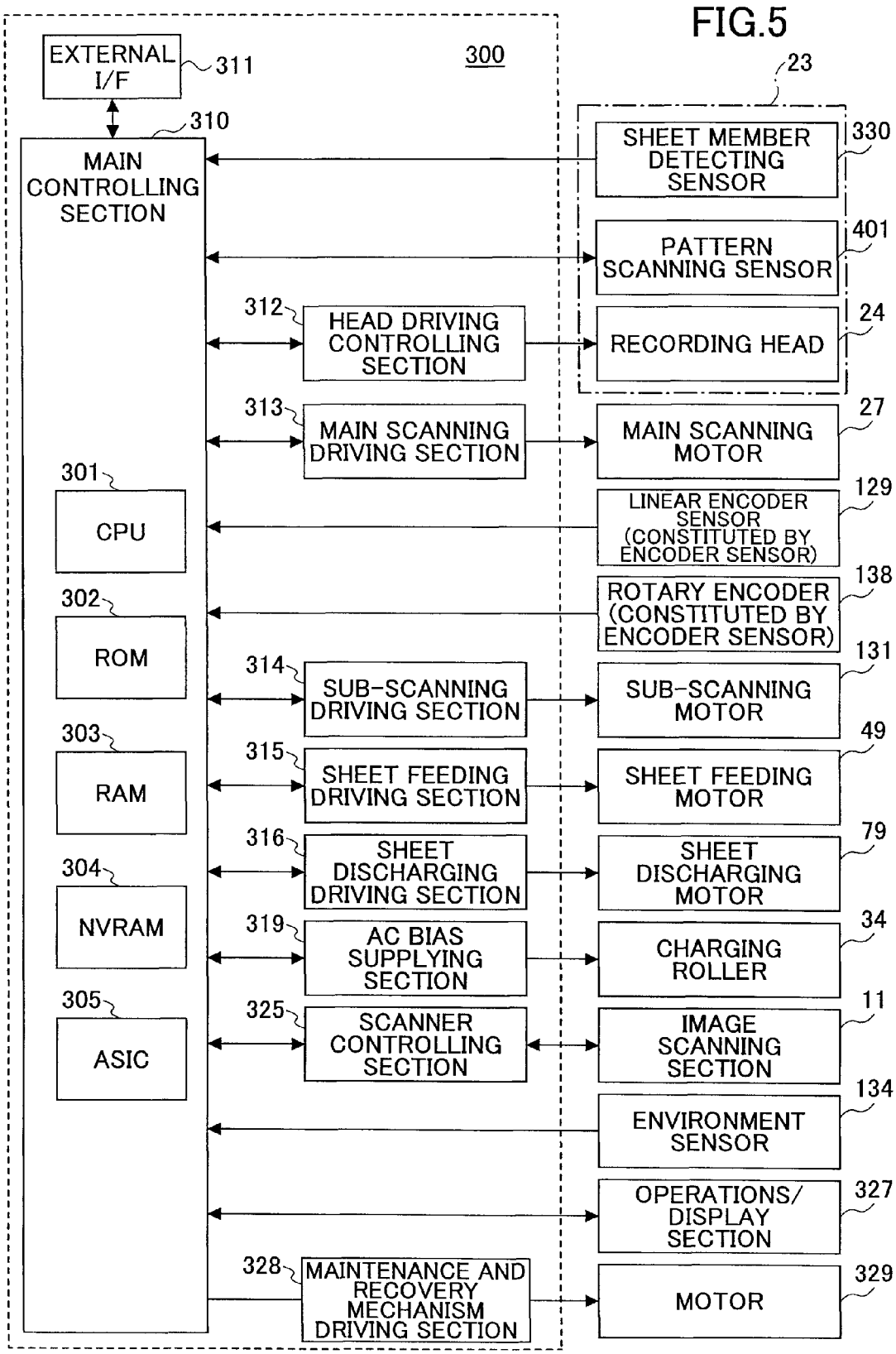
FIG. 5 is a block diagram of a control block of the image forming apparatus.

Next, referring to the block diagram of FIG. 5, a description is made of a brief outline of a control block of the image forming apparatus.

The control block 300 includes a main controlling section 310 having a CPU 301, a ROM 302 that stores programs executed by the CPU 301 and other fixation data, a RAM 303 that temporarily stores image data and the like, a non-volatile memory (NVRAM) 304 that maintains data even while the power of the apparatus is interrupted, and an ASIC 305 that processes various signals to and from image data and input/output signals for controlling the entire apparatus and image processing in which images are arranged. The main controlling section 310 controls the formation of an adjustment pattern according to the embodiments of the present invention, the detection of the adjustment pattern, and the adjustment (correction) of shooting positions as well as the entire apparatus.

Furthermore, the control block 300 includes an external I/F 311, a head driving controlling section 312, a main scanning driving section (motor driver) 313, a sub-scanning driving section (motor driver) 314, a sheet feeding driving section 315, a sheet discharging driving section 316, an AC bias supplying section 319, and a scanner controlling section 325. The external I/F 311 is interposed between a host and the main controlling section 310 and transmits and receives data and signals. The head driving controlling section 312 includes a head driver (actually provided at the recording head 24) composed, e.g., of a head data generation and arrangement converting ASIC used to control the driving of the recording head 24. The main scanning driving section 313 drives the main scanning motor 27 that moves the carriage 23 to perform a scanning operation. The sub-scanning driving section 314 drives the sub-scanning motor 131. The sheet feeding driving section 315 drives the sheet feeding motor 49. The sheet discharging driving section 316 drives a sheet discharging motor 79 that drives each roller of the sheet discharge conveying section 7. The AC bias supplying section 319 supplies an AC bias to the charging roller 34. Although not shown in FIG. 5, the scanner controlling section 325 controls a recovery system driving section that drives a maintenance and recovery motor to drive the maintenance and recovery mechanism 121, a double-side driving section that drives a double-sided unit when the double-sided unit is mounted, a solenoids driving section (driver) that drives various solenoids (SOL), a clutch driving section that drives an electromagnetic clutch and the like, and the image scanning section 11.

Furthermore, the various detection signals from an environment sensor 134 that detects ambient temperature and humidity (environmental conditions) of the conveying belt 31 are input to the main controlling section 310. Note that although the detection signals from various sensors (not shown) are also input to the main controlling section 310, they are omitted here. Moreover, the main controlling section 310 imports a necessary key input and exports display information from and to an operations/display section 327 including various keys such as a numeric key pad and a print start key provided in the apparatus main body 1 and various display devices.

Furthermore, the output signal from the photosensor (encoder sensor) 129 constituting a linear encoder that detects the position of the carriage is input to the main controlling section 310. The main controlling section 310 controls the driving of the main-scanning motor 27 through the main scanning driving section 313 based on this output signal, thereby making the carriage 23 reciprocate in the main scanning direction. In addition, the output signal (pulse) from the photosensor (encoder sensor) 138 constituting a rotary encoder 138 that detects the movement amount of the conveying belt 31 is input to the main controlling section 310. The main controlling section 310 controls the driving of the sub-scanning motor 131 through the sub-scanning driving section 314 based on this output signal, thereby making the conveying belt 31 move through the rotation of the conveying roller 32.

Moreover, the main controlling section 310 forms an adjustment pattern on the conveying belt 31 and causes a light emitting element 402 of the pattern scanning sensor 401 mounted on the carriage 23 to emit light to the formed adjustment pattern. At the same time, the main controlling section 310 receives the output signal from a light receiving element 403 to scan the adjustment patterns, detects the deviation amount of shooting positions from the scanned results, and corrects liquid droplet ejection timing of the recording head 24 based on the deviation amount of the shooting positions so as to eliminate the deviation of the shooting positions. Note that this controlling operation is described in detail below.

Furthermore, when the main controlling section 310 performs the maintenance and recovery operation of the recording head 24, it controls the driving of the driving motor 329 of the maintenance and recovery mechanism 121 through a maintenance and recovery mechanism driving section 238 to perform, for example, the movements of the cap 122 and the blade (wiper member) 124.

The image forming apparatus having such a configuration detects the rotation amount of the conveying roller 32 that drives the conveying belt 31, controls the driving of the sub-scanning motor 131 in accordance with the detected rotation amount, and applies rectangular-wave high voltage of positive and negative poles as alternating current to the charging roller 34 from the AC bias supplying section 319. Accordingly, positive and negative electric charges are alternately applied to the conveying belt 31 in the conveying direction in a belt shape, so that the conveying belt 31 is charged in a prescribed charging width to generate a non-uniform electric field.

When the sheet 5 is fed from the sheet feeding section 4, delivered between the conveying roller 32 and the first pressure roller 36, and placed on the conveying belt 31 where the positive and negative charges are formed to generate the non-uniform electric field, it is instantaneously polarized to follow the direction of the electric field, attached onto the conveying belt 31 by an electrostatic attraction force, and conveyed along with the movement of the conveying belt 31.

The sheet 5 is intermittently conveyed by the conveying belt 31. Then, between the conveyances the carriage 23 is caused to move in the main scanning direction so that liquid droplets of a recording liquid are ejected from the recording head 24 onto the sheet 5 to record (print) images. The sheet 5 on which printing is performed is separated from the conveying belt 31 at its tip end by the separating claw 39, delivered to the sheet discharge conveying section 7, and discharged to the sheet discharging tray 8.

Furthermore, during standby for performing a printing (recording) operation, the carriage 23 is moved to the side of the maintenance and recovery mechanism 121 where the nozzle surface of the recording head 24 is capped by the cap 122 to keep the nozzles moist, thereby preventing an ejection failure due to the drying of ink. Furthermore, recording liquid is suctioned where the recording head 24 is capped by the suction and moisturizing cap 122*a* to perform a recovery operation in which the recording liquid increased in viscosity and air bubbles is discharged. In the recovery operation, the wiper blade 124 is used to perform a wiping operation to clean and remove the ink adhering onto the nozzle surface of the recording head 24. Furthermore, idle ejection is performed before the start of or in the middle of recording images in which the ink not used for the recording is ejected into the idle ejection receiver 125, thereby maintaining the stable ejection performance of the recording head 24.

Figure 6:
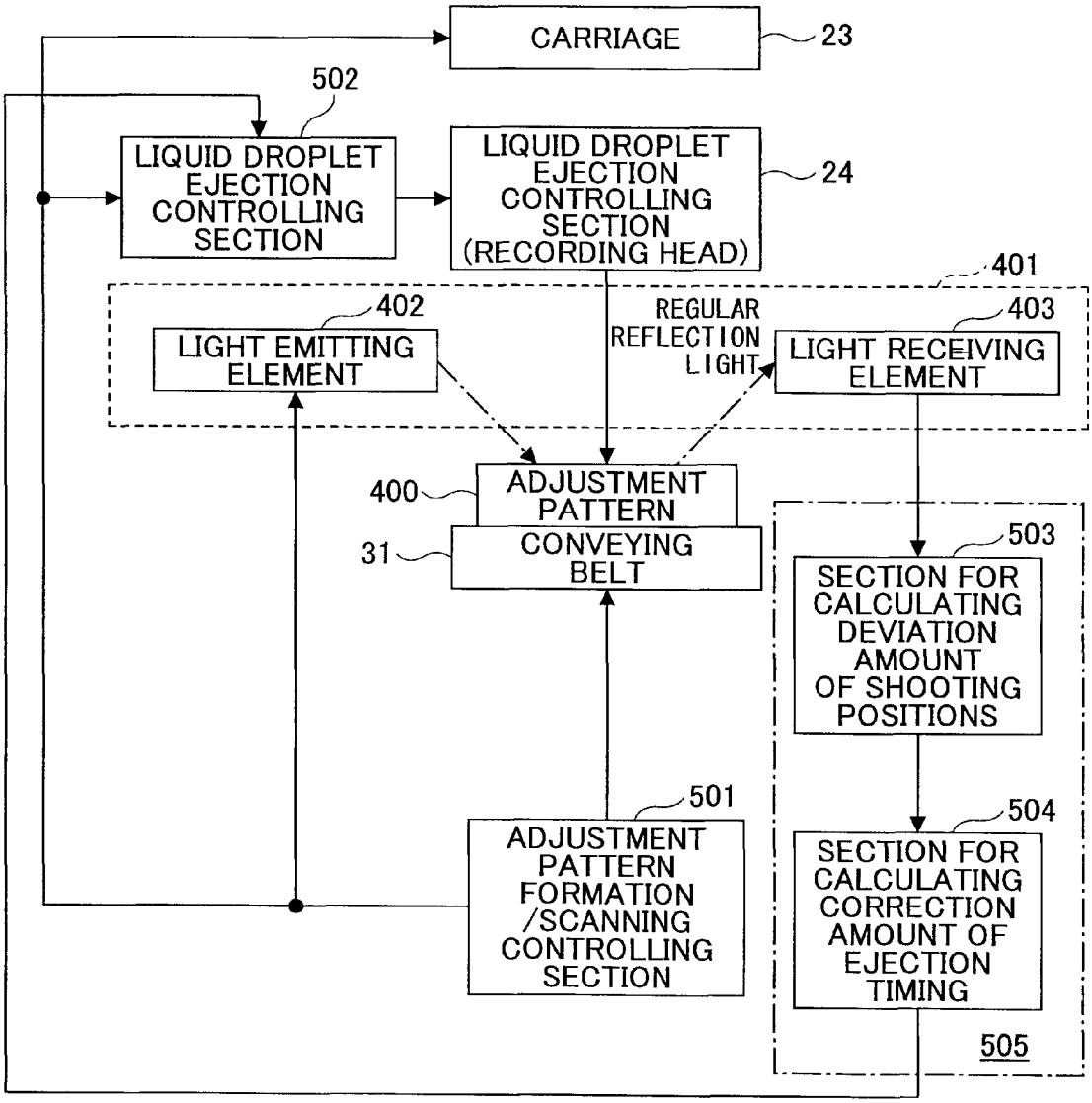
FIG. 6 is a block diagram of sections for detecting and correcting shooting positions of liquid droplets in the image forming apparatus.
Figures 7A, 7B:
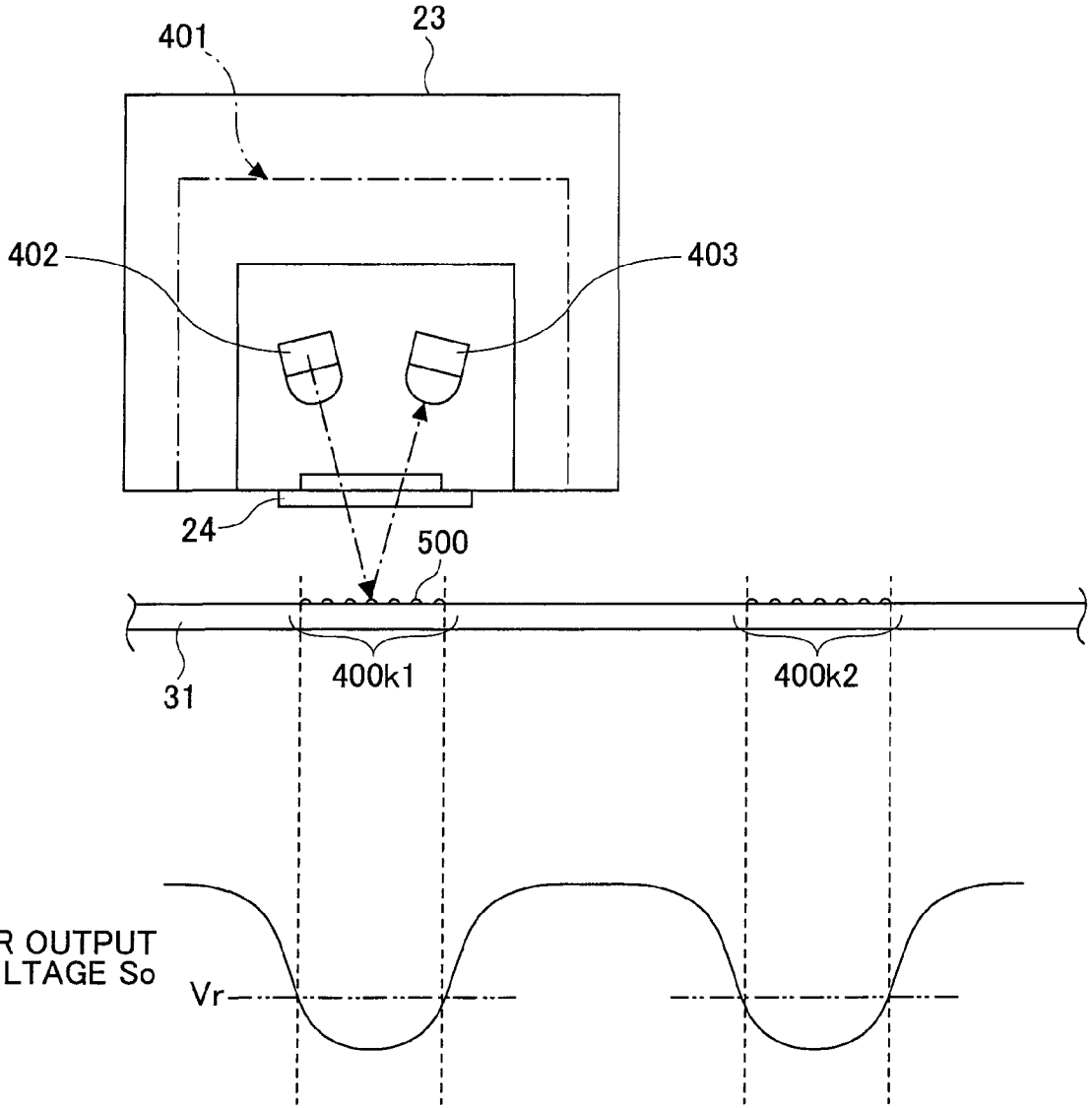
FIGS. 7A and 7B are explanatory diagrams of an operation for correcting the deviation of shooting positions of liquid droplets.

Next, referring to FIGS. 6 and 7A and 7B, a description is made of a part related to control for correcting the deviation of shooting positions of liquid droplets in the image forming apparatus. Note that FIG. 6 is a block diagram of a section for correcting the deviation of shooting positions of liquid droplets and FIGS. 7A and 7B are diagrams explaining an operation for correcting the deviation of shooting positions of liquid droplets.

Figure 8:
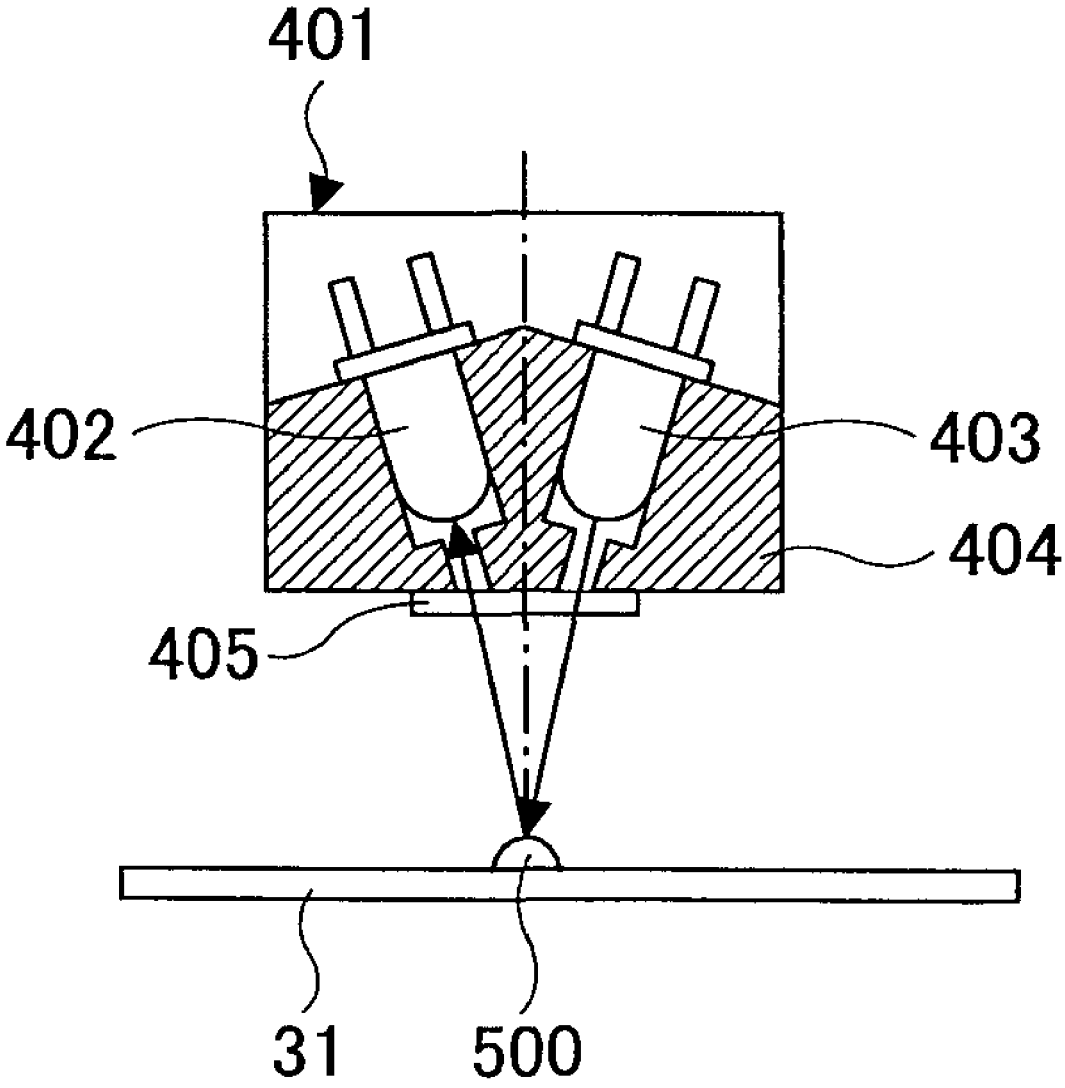
FIG. 8 is an explanatory diagram of a pattern scanning sensor.

First, as shown in FIGS. 7A, 7B, and 8, the carriage 23 is provided with a pattern scanning sensor 401 that detects a pattern 400 (used synonymously with a test pattern, a detection pattern, etc., although called the adjustment pattern here) for detecting the deviation of the shooting positions of liquid droplets formed on the conveying belt 31 as a water-repellent member on which a pattern is formed. Note that the adjustment pattern 400 refers to at least a reference pattern 400*k*1 and a pattern 400*k*2 to be measured.

The pattern scanning sensor 401 holds in a holder 404 the light emitting element 402 as the light emitting section for emitting light to the adjustment pattern 400 on the conveying belt 31 and the light receiving element 403 as the light receiving section for receiving the regular reflection light from the adjustment pattern 400, which elements 402 and 403 are arranged in a direction orthogonal to the main scanning direction. Note that a lens 405 is provided at an emitting part and an incident part of the holder 404.

As shown in FIG. 2, the light emitting element 402 and the light receiving element 403 in the pattern scanning sensor 401 are arranged in a direction orthogonal to the main scanning direction of the carriage 23. Accordingly, it is possible to reduce the influence on detection results due to a variation in the moving speed of the carriage 23. Furthermore, a relatively simple and inexpensive light source such as an infrared-range LED or a visible light can be used as the light emitting element 402. Since the spot diameter (detection range or detection area) of a light source is produced by an inexpensive lens instead of a high accuracy lens, a millimeter order of detection range is achieved.

When instructions for correcting the deviation of shooting positions are issued, an adjustment pattern formation/scanning controlling section 501 causes the carriage 23 to scan in a reciprocating manner in the main scanning direction relative to the conveying belt 31. At the same time, the adjustment pattern formation/scanning controlling section 501 causes the recording head 24 as a liquid droplet ejection section to eject liquid droplets through a liquid droplet ejection controlling section 502 to form the line-shaped reference pattern 400*k*1 and the pattern 400*k*2 to be measured (called the adjustment pattern 400) formed of plural independent liquid droplets 500.

Furthermore, the adjustment pattern formation/scanning controlling section 501 scans the adjustment pattern 400 formed on the conveying belt 31 with the pattern scanning sensor 401. The adjustment pattern scanning control is performed by driving the light emitting element 402 of the pattern scanning sensor 401 to emit light, so that the light emitted from the light emitting element 402 is transmitted to the adjustment pattern 400 on the conveying belt 31.

In the pattern scanning sensor 401, when the light emitted from the light emitting element 402 is incident on the adjustment pattern 400 on the conveying belt 31, the regular reflection light reflected from the adjustment pattern 400 is incident on the light receiving element 403 and a detection signal corresponding to a light receiving amount of the regular reflection light from the adjustment pattern 400 is output from the light receiving element 403 so as to be input to a section 503 for calculating the deviation amount of shooting positions of a shooting position correcting section 505.

The section 503 for calculating the deviation amount of shooting positions of the shooting position correcting section 505 detects the position of the adjustment pattern 400 based on the output results from the light receiving element 403 of the pattern scanning sensor 401 to calculate the deviation amount (deviation amount of shooting positions of liquid droplets) relative to the reference position. The shooting position deviation amount calculated by the section 503 for calculating the deviation amount of shooting positions is supplied to a section 504 for calculating a correction amount of ejection timing 504. The section 504 calculates the correction amount of ejection timing when the liquid droplet ejection controlling section 502 drives the recording head 24 so as to eliminate the deviation amount of shooting positions and sets the calculated ejection timing correction amount in the liquid droplet ejection controlling section 502. Accordingly, the liquid droplet ejection controlling section 502 drives the recording head 24 after correcting the ejection timing based on the correction amount. As a result, the deviation amount of shooting positions of liquid droplets is reduced.

Here, an area on which patterns can be formed refers to an area that is not damaged, stained, or tarnished on the conveying belt 31 and can be scanned with high accuracy even if the adjustment pattern 400 is formed on it.

Here, referring to FIGS. 9A and 9B through 13, a description is made of the formation of the adjustment pattern 400 and a principle of detecting the adjustment pattern 400.

Figures 9A, 9B:
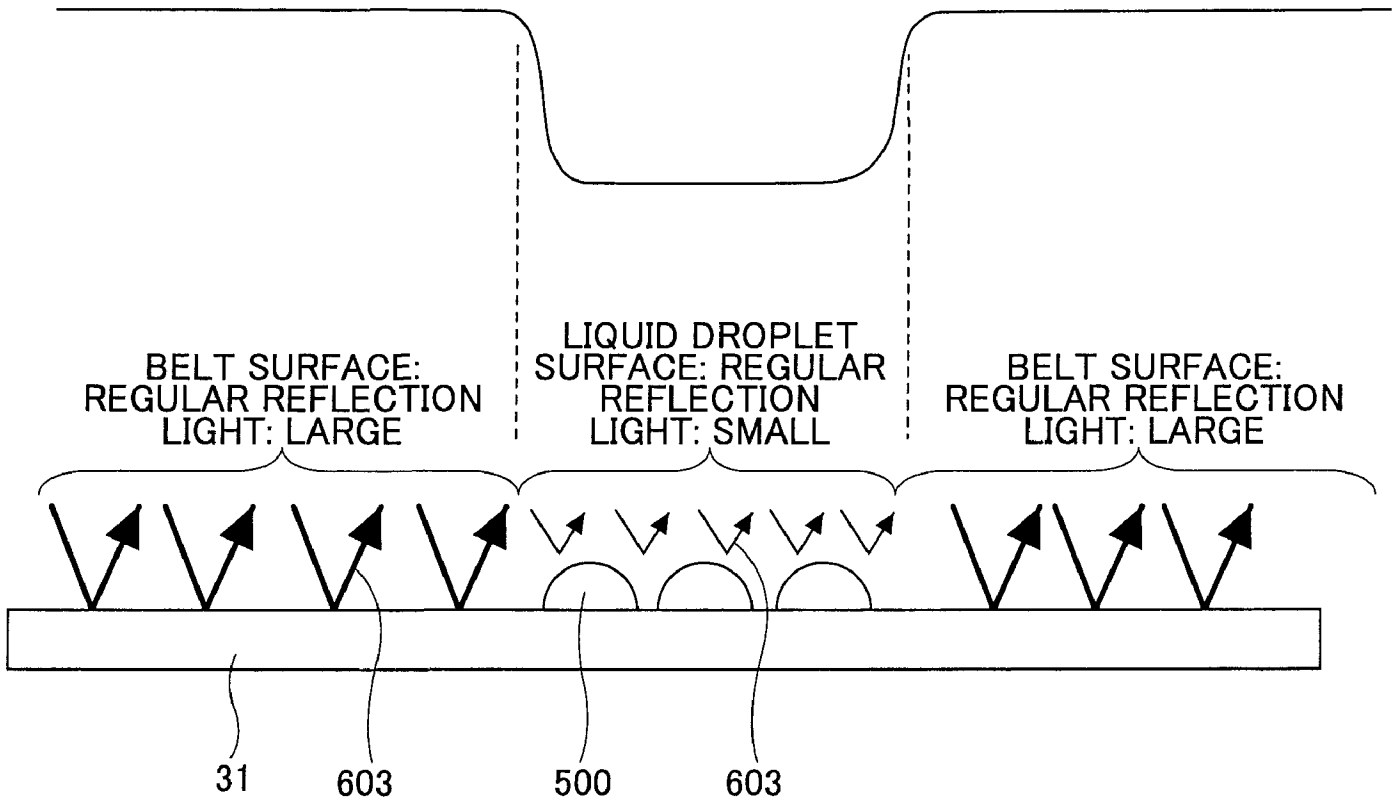
FIGS. 9A and 9B are diagrams explaining the formation of an adjustment pattern on the conveying belt and a principle of detecting the adjustment pattern.
Figure 11:
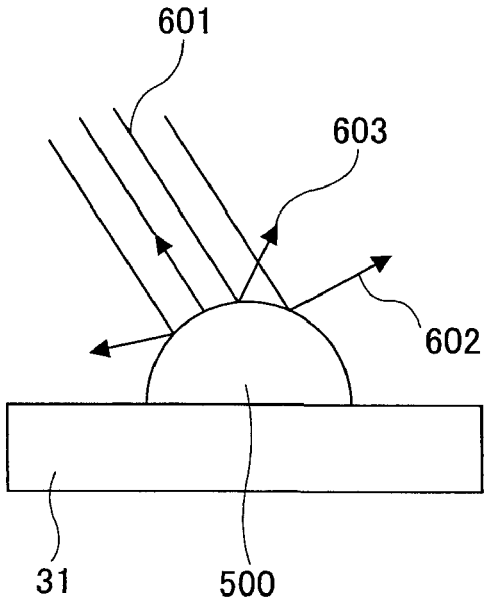
FIG. 11 is a diagram explaining the principle of detecting the adjustment pattern, where light is diffused from a liquid droplet.

First, as shown in FIG. 9B, the adjustment pattern 400 is formed on the conveying belt 31 with the plural independent ink droplets 500 (turn into semispherical shapes upon impact). As shown in FIG. 11, in the case of the incidence of the light from the light-emitting element 402, when the light 601 is incident on the ink droplet 500, most of the incident light 601 turns into diffused reflection light 602 and only a small amount of regular reflection light 603 is detected because the ink droplet 500 has a curved gloss surface.

Assume that the front surface (belt surface) of the conveying belt 31 has a gloss finish, thus making regular reflection light easily returned when light from the light emitting element 402 is incident. When the light from the light-emitting element 402 of the pattern scanning sensor 401 is incident onto the adjustment pattern 400 composed of the plural independent ink droplets 500 formed on the conveying belt 31 so as to scan them, the incident light is diffused at the front surfaces of the semispherical and glossy ink droplets 500, resulting in a reduced amount of the regular reflection light 603 at the adjustment pattern 400. Accordingly, the output (sensor output voltage So) of the light receiving element 403 that receives the regular reflection light 603 becomes relatively small.

As a result, the position of the adjustment pattern 400 formed on the conveying belt 31 can be detected based on the sensor output voltage So of the pattern scanning sensor 401.

Figures 10A, 10B:
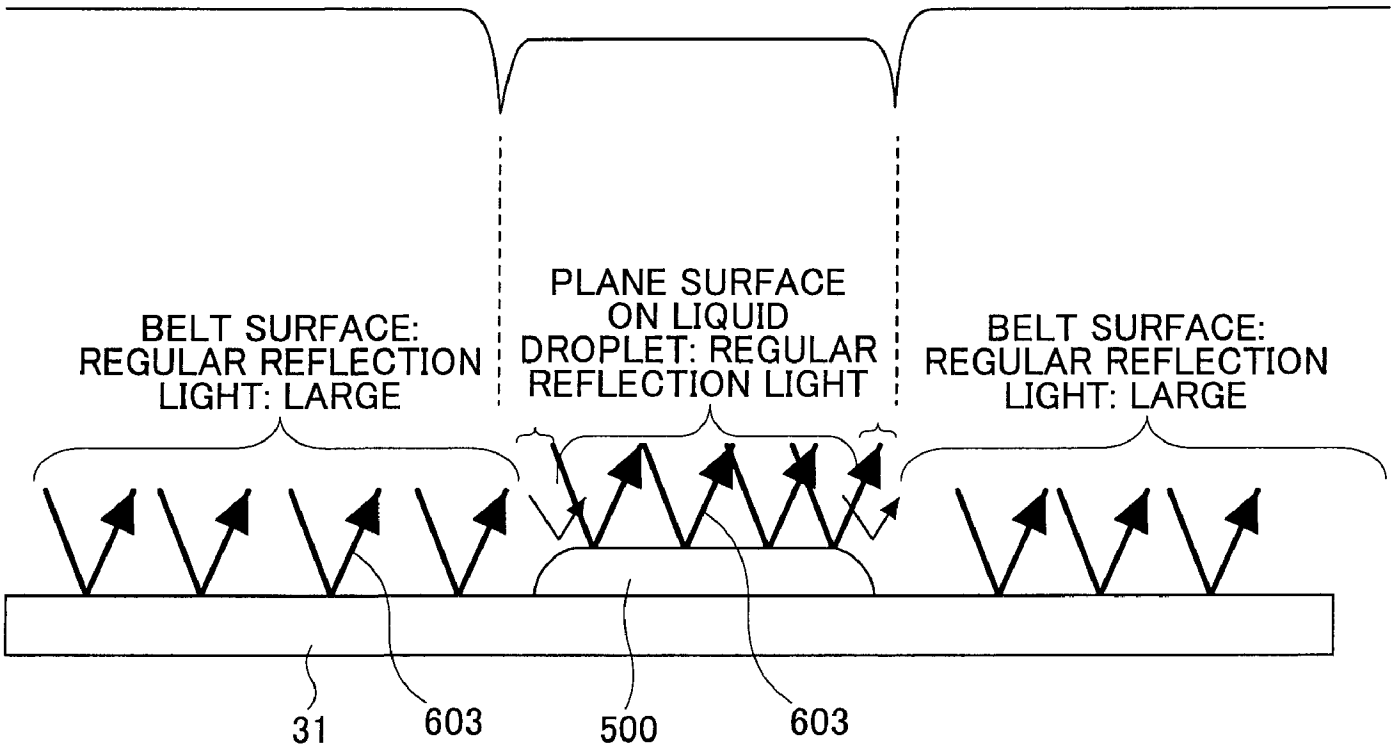
FIGS. 10A and 10B are explanatory diagrams of the adjustment pattern in a comparative example.

Conversely, as shown in FIG. 10B, when the adjacent ink droplets come in contact and are connected to each other on the conveying belt 31, the top surfaces of the connected ink droplets 500 become flat, resulting in an increased amount of the regular reflection light 603. Accordingly, as shown in FIG. 10A, the sensor output voltage So becomes substantially the same as that of the surface of the conveying belt 31, thereby making it difficult to detect the positions of the ink droplets 500. Note that even if the ink droplets are connected to each other, diffused light is generated between the ends of the connected ink droplets. However, it is difficult to detect the generated areas of diffused light because they are extremely limited. If it is attempted to detect them, the areas (ranges to be detected) viewed by the light receiving element 403 must be narrowed down. In this case, there is a possibility of reacting with noise factors such as a very small flaw or dust on the front surface of the light receiving element 403, resulting in degraded detection accuracy and reliability of detection results.

Figure 12:
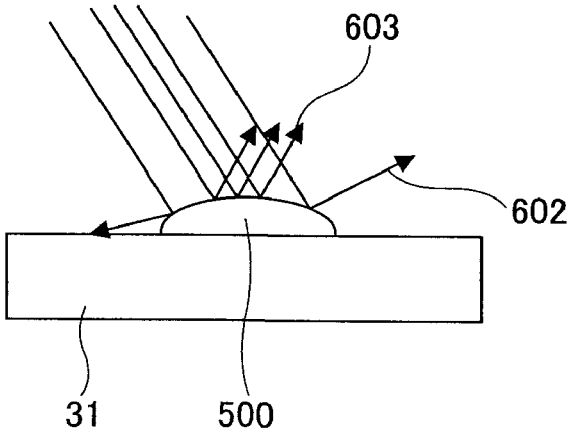
FIG. 12 is a diagram explaining the principle of detecting the adjustment pattern, where light is diffused when a liquid droplet is flattened.
Figure 13:
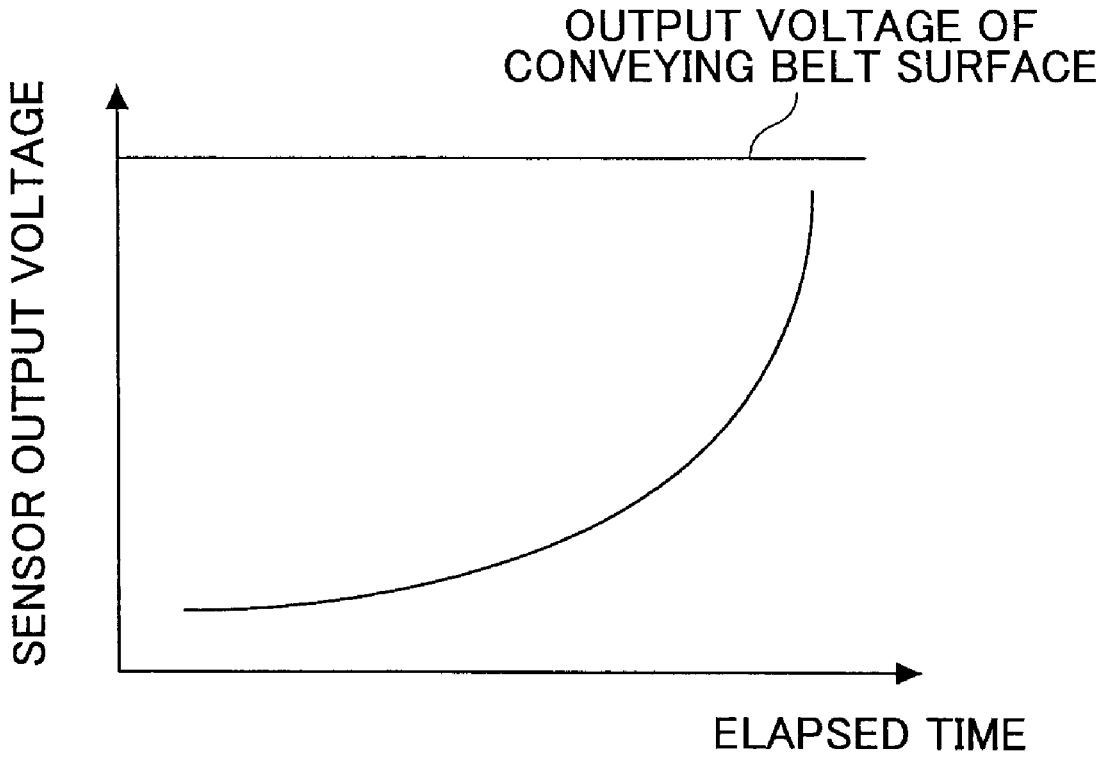
FIG. 13 is a graph explaining a relationship between elapsed time and a change in a sensor output voltage after liquid droplets are shot.

Note that as shown in FIG. 12, the gloss will be lost from the front surface and the semispherical shape of the ink droplet 500 will be gradually changed to a flattened shape with time. Therefore, the range and proportion of generating the regular reflection light 603 become relatively large compared with the diffused reflection light 602. Accordingly, as shown in FIG. 13, when the regular reflection light 603 is received by the light receiving element 403, the sensor output voltage So comes close to the output voltage when the reflection light is received from the surface of the conveying belt 31 and detection accuracy is reduced with time. Therefore, the adjustment pattern 400 is preferably detected before the ink droplet 500 formed as the adjustment pattern 400 becomes flat.

As described above, a part representing attenuated regular reflection light is determined according to the outputs from the light receiving element 403 that receives the regular reflection light from the ink droplets, thereby making it possible to detect the pattern with high accuracy. In this case, the adjustment pattern 400 is preferably composed of plural independent liquid droplets in the detection range of the pattern scanning sensor 401. Moreover, the ink droplets are preferably packed in a dense manner (area between the liquid droplets is smaller relative to the adhesion area of the liquid droplets in the detection range).

In view of such characteristics of the liquid droplets, according to an embodiment of the present invention, the adjustment pattern composed of plural independent liquid droplets is formed on the water-repellent belt 31. It is thereby possible to detect the adjustment pattern with the change of the received amount of the regular reflection light from the adjustment pattern with high accuracy. As a result, the deviation of a gap can be adjusted with high accuracy.

Next, referring to FIGS. 14A and 14B through 16A and 16B, a description is made of another example of a position detection process for the adjustment pattern 400 formed on the conveying belt 31 and a distance calculation process between the reference pattern **400*k*1 and the pattern 400*k*2** to be measured.

Figure 14A:
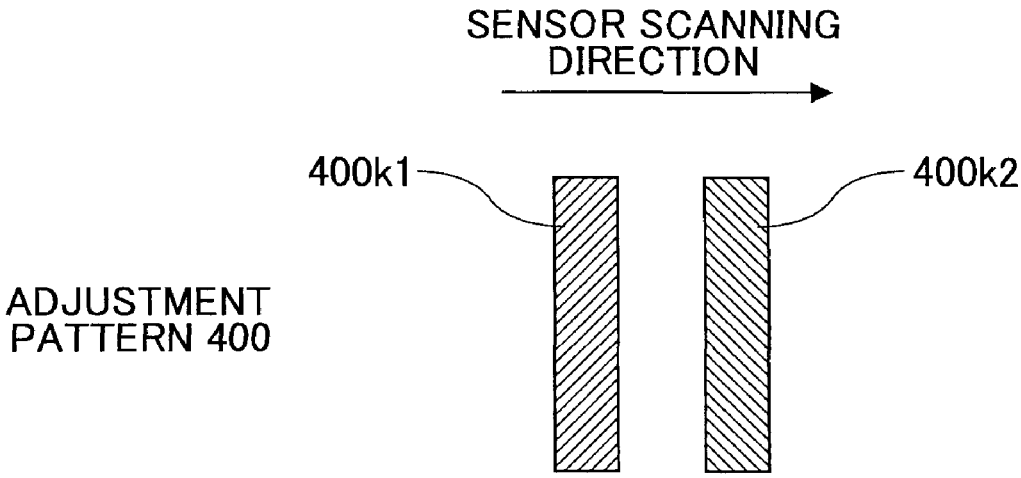
FIGS. 14A and 14B are diagrams explaining a first example of a position detection process for the adjustment pattern.
Figure 14B:
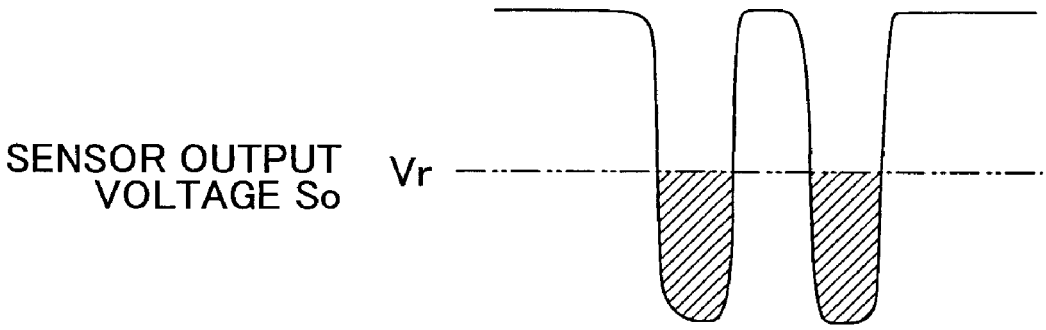

As a first example shown in FIG. 14A, the reference pattern **400*k*1 and the pattern 400*k*2 to be measured are formed on the conveying belt 31. These patterns 400*k*1 and 400*k*2 are scanned by the pattern scanning sensor 401 in the sensor scanning direction (carriage main scanning direction). Accordingly, as shown in FIG. 14B, the sensor output voltage So that falls at the reference pattern 400*k*1 and the pattern 400*k*2 to be measured is obtained from the output results of the light receiving element 403 of the pattern scanning sensor 401**.

Here, when the sensor output voltage So and a previously set threshold Vr are compared with each other, it is possible to detect positions, at which the sensor output voltage So falls below the threshold Vr, as the edges of the reference pattern **400*k*1 and the pattern 400*k*2 to be measured. At this time, the geometric centers of the areas (parts indicated by oblique lines in FIG. 14B) encircled by the threshold Vr and the sensor output voltage So are calculated to be set as the centers of the patterns 400*k*1 and 400*k*2**, respectively. Accordingly, it is possible to reduce an error caused by a small fluctuation of the sensor output voltage by using the geometric centers of the areas.

Figure 15A:
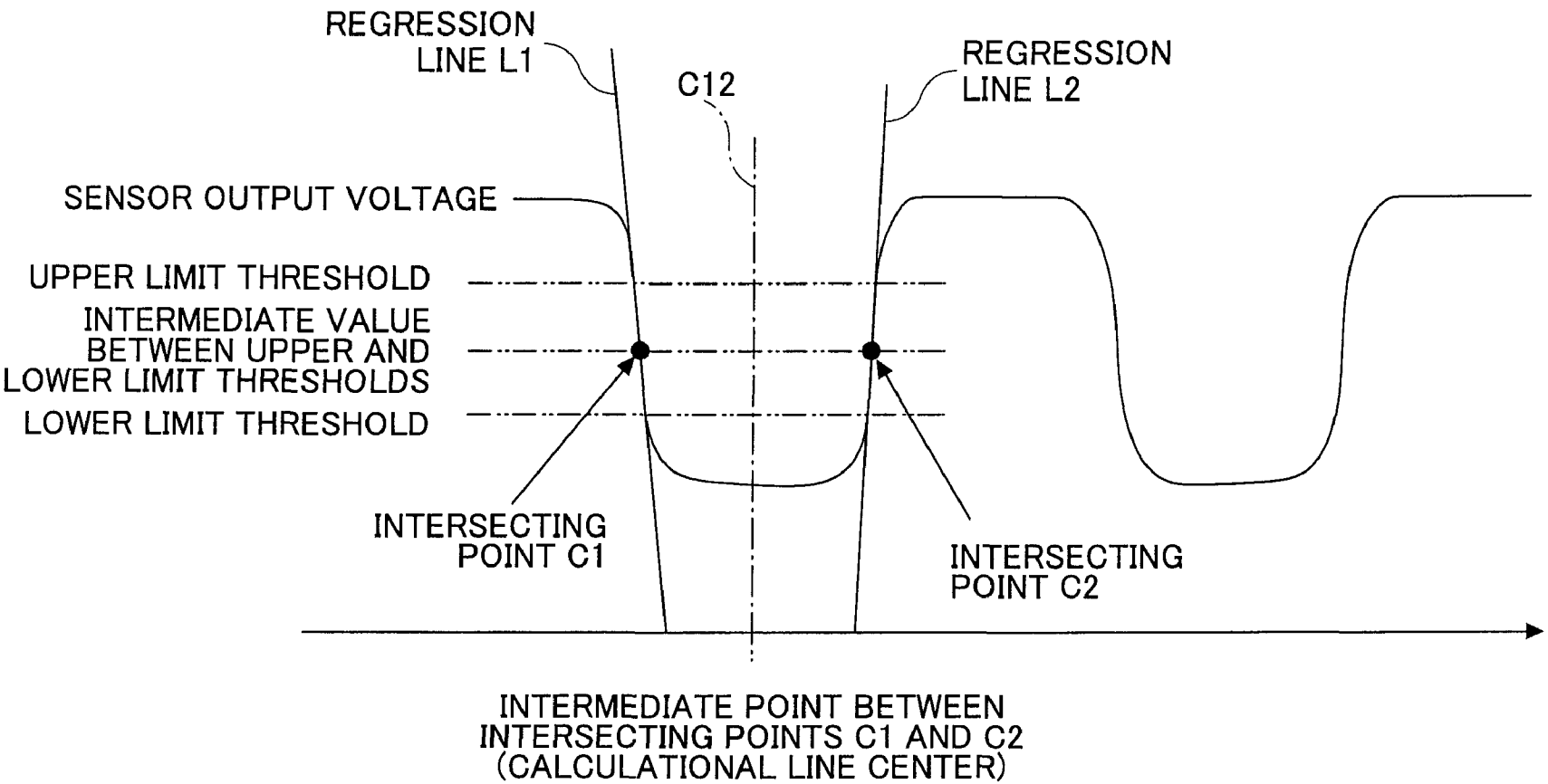
FIGS. 15A and 15B are diagrams explaining a second example of the position detection process for the adjustment pattern.
Figure 15B:
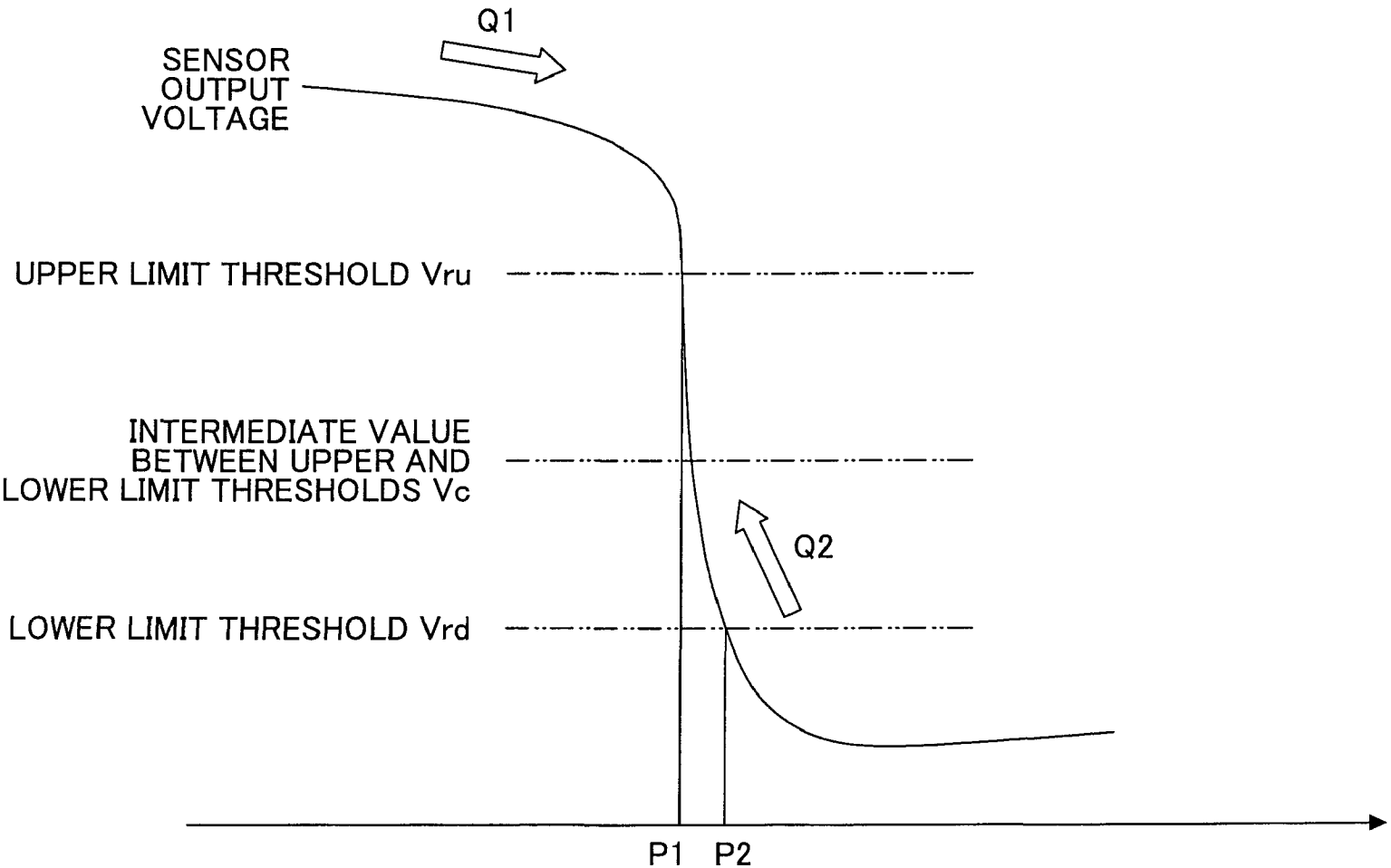

As a second example shown in FIGS. 15A and 15B, the reference pattern **400*k*1 and the pattern 400*k*2 to be measured equivalent to those of the first example are scanned by the pattern scanning sensor 401 to obtain the sensor output voltage So as shown in FIG. 15A. FIG. 15**B shows the enlargement of the falling part of the sensor output voltage So.

Here, the falling part of the sensor output voltage So is searched in the direction of an arrow Q1 in FIG. 15B, and the point at which the sensor output voltage So falls below (becomes smaller than equal to) the lower limit threshold Vrd is stored as the point P2. Next, the sensor output voltage So is searched from the point P2 in the direction of an arrow Q2, and the point at which the sensor output voltage So exceeds the upper limit threshold Vru is stored as the point P1. Then, the regression line L1 is calculated from the output voltage So between the points P1 and P2, and an intersecting point between the regression line L1 and the intermediate value Vrc between the upper and lower limit thresholds is calculated using the obtained regression line and set as an intersecting point C1. Similarly, the regression line L2 is calculated with respect to the rising part of the sensor output voltage So, and an intersecting point between the regression line L2 and the intermediate value Vrc between the upper and lower limit thresholds is calculated and set as an intersecting point C2. Accordingly, the line center C12 is referred to based on the equation (intersecting point C1+intersecting point C2/2) using the intermediate point between the intersecting points C1 and C2.

Figures 16A, 16B:
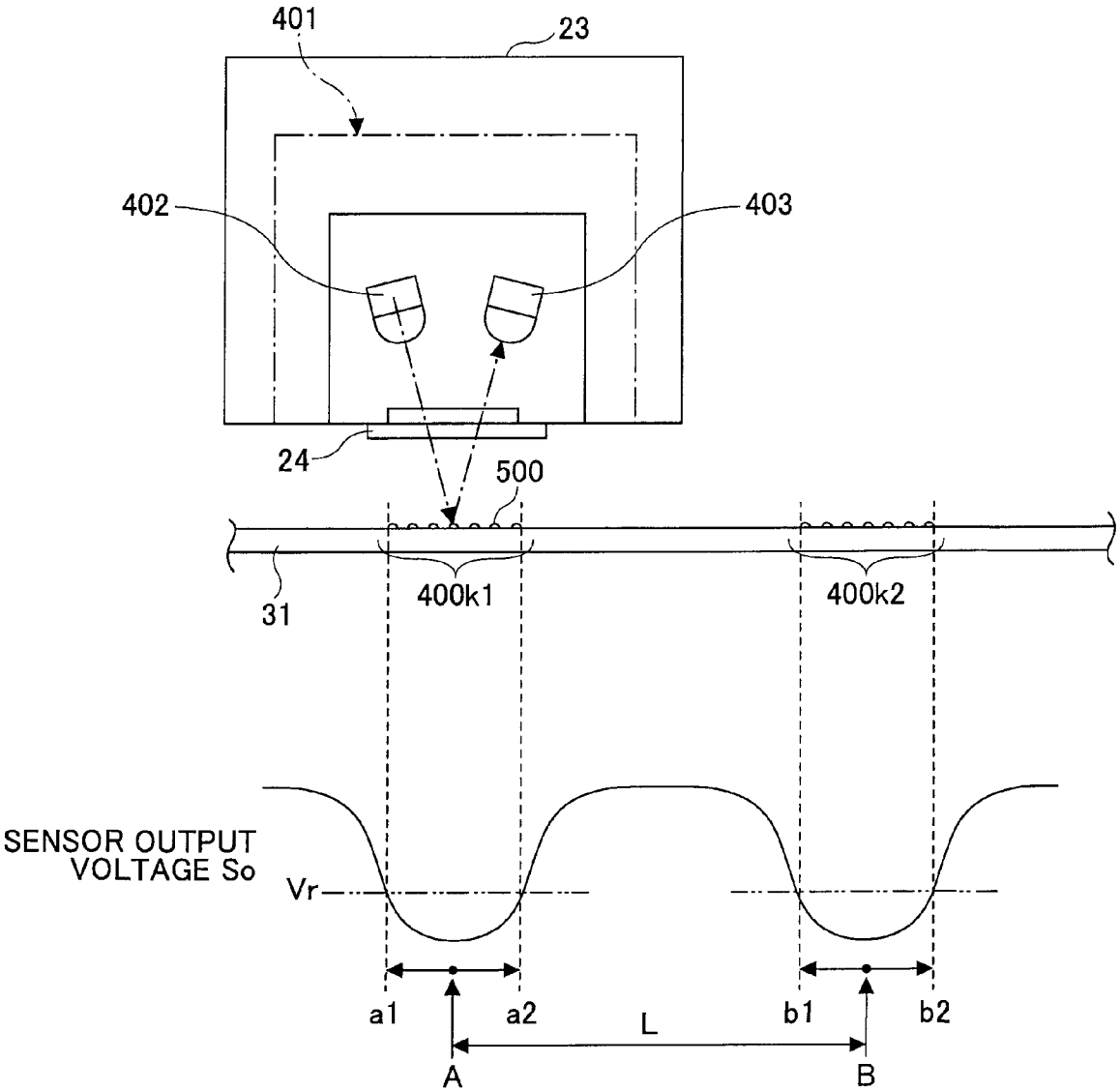
FIGS. 16A and 16B are diagrams explaining a third example of the position detection process for the adjustment pattern.

As a third example shown in FIG. 16A, the reference pattern **400*k*1 and the pattern 400*k*2 to be measured are formed on the conveying belt 31 in the same manner as that of the first example. These patterns 400*k*1 and 400*k*2 are scanned by the pattern scanning sensor 401 in the sensor scanning direction. Accordingly, the sensor output voltage (photoelectric conversion output voltage) So as shown in FIG. 16**B is obtained.

At this time, harmonic noise is eliminated with a IIR filter, and then the quality (presence or absence of, instability, and redundancy) of a detection signal is evaluated. As a result, an inclination part near the threshold Vr is detected to calculate a regression curve. After that, intersecting points a1, a2, b1, and b2 between the regression curve and the threshold Vr are calculated (actually computed with a position counter) to compute an intermediate point A between the intersecting points a1 and a2 and an intermediate point B between the intersecting points b1 and b2.

Figure 18:
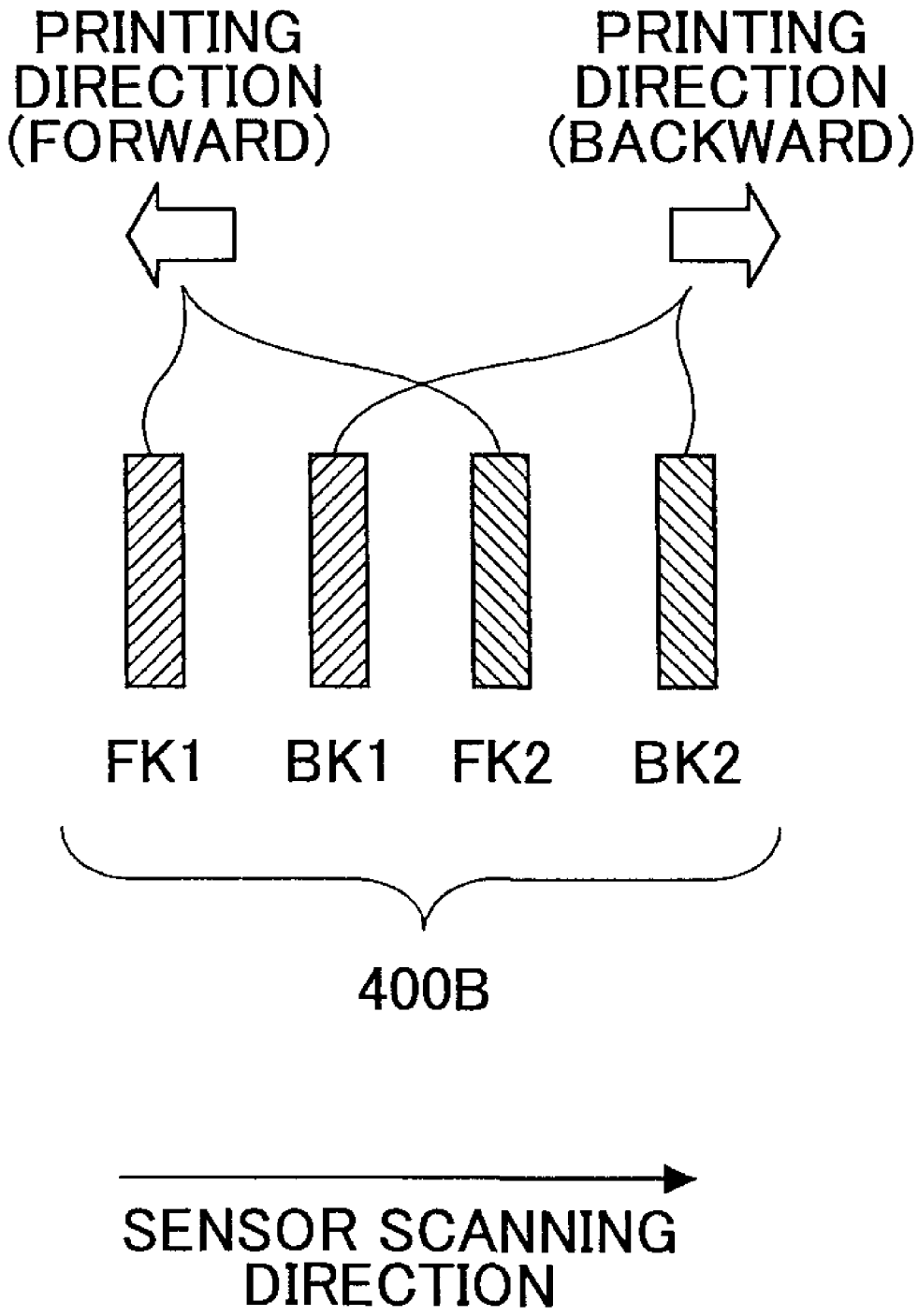
FIG. 18 is a diagram explaining the adjustment pattern for the deviation of ruled lines.

Next, referring to FIG. 18, a description is made of a minimum unit (also called a basic pattern) that constitutes the adjustment pattern 400 according to the image forming apparatus and detects the deviation of shooting positions.

As described above, in the method for correcting the deviation of shooting positions of the image forming apparatus, the reference recording head (color) forms the line-shaped reference pattern in the direction orthogonal to the feeding direction of the conveying belt 31, and other recording heads (color) form similar line-shaped reference patterns at specific intervals. Based on these patterns, the distance between the reference recording head and other recording heads is calculated (measured).

Figure 17A:
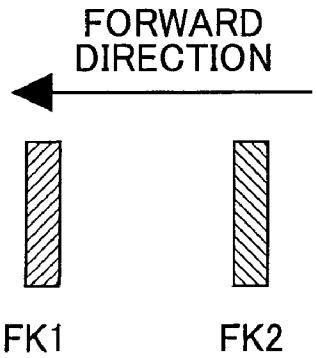
FIGS. 17A through 17D are diagrams explaining a block pattern (reference pattern)
Figure 17B:
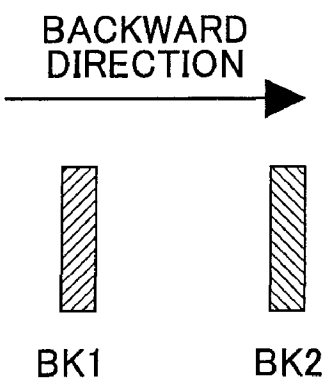
Figure 17C:
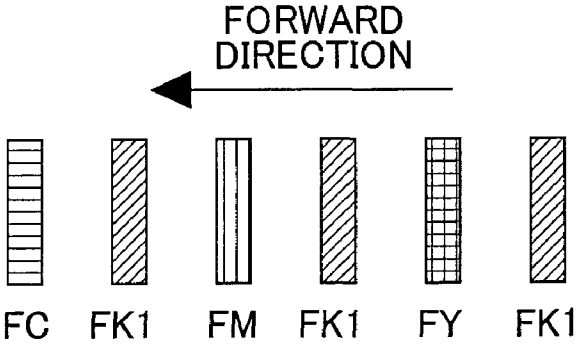
Figure 17D:
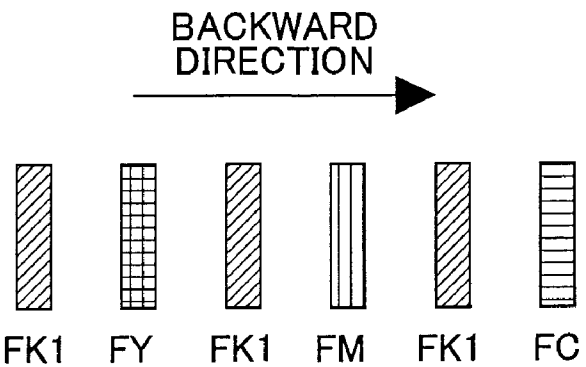

Here, there are four types of block patterns (reference patterns) as minimum reference items. With a first pattern shown in FIG. 17A, the deviation of shooting positions of a pattern FK2 to be measured, which is formed by a recording head 24*k*2, is detected based on the position of a reference pattern FK1 formed by a recording head 24*k*1 in a forward movement (first scan). With a second pattern shown in FIG. 17B, the deviation of shooting positions of a pattern BK2 to be measured, which is formed by a recording head 24*k*1, is detected based on the position of a reference pattern BK1 formed by the recording head 24*k*1 in a backward movement (second scan). With a third pattern shown in FIG. 17C, the deviation of shooting positions of patterns FC, FM, and FY to be measured in colors (C, M, and Y), which are respectively formed by recording heads 24*c*, 24*m*, and 24*y*, is detected based on the position of the reference pattern FK1 formed by the recording head 24*k*1 in the forward movement (third scan). With a fourth pattern shown in FIG. 17D, the deviation of shooting positions of the patterns FC, FM, and FY to be measured in the colors (C, M, and Y), which are respectively formed by the recording heads 24*c*, 24*m*, and 24*y*, is detected based on the position of the reference pattern FK1 formed by the recording head 24*k*1 in the backward movement. With the combination of these block patterns, an adjustment pattern that provides various detection contents can be constituted.

Particularly, the image forming apparatus described above has the two recording heads 24*k*1 and 24*k*2 that eject black liquid droplets. Therefore, not only the deviation of shooting positions in bidirectional printing with one recording head, but also the deviation of shooting positions between the two recording heads 24*k*1 and 24*k*2 may be caused. Accordingly, the image forming apparatus has also a pattern for detecting the deviation of shooting positions of the pattern FK2 formed by the recording head 24*k*2 based on the position of the pattern FK1 formed by the recording head 24*k*1.

Next, referring to FIGS. 18 and 19, a description is made of the adjustment pattern for the deviation of monochrome ruled lines and the adjustment pattern for adjusting a color shift caused by different colors using the block patterns.

In the adjustment pattern 400B for adjusting the deviation of ruled lines shown in FIG. 18, the pattern BK1, the pattern FK2, and the pattern BK2 (which are the patterns to be measured) are printed in the backward movement, the forward movement, and the backward movement, respectively, based on the position of the pattern FK1 (using the pattern FK1 as a reference pattern) in the reference direction (as the forward movement). Based on the position information of the patterns FK1, BK1, FK2, and BK2, the deviation of shooting positions relative to the pattern FK1 as the reference pattern can be detected. Note that a sensor scanning direction refers to a case in which the patterns are scanned only in one direction.

Figure 19A:
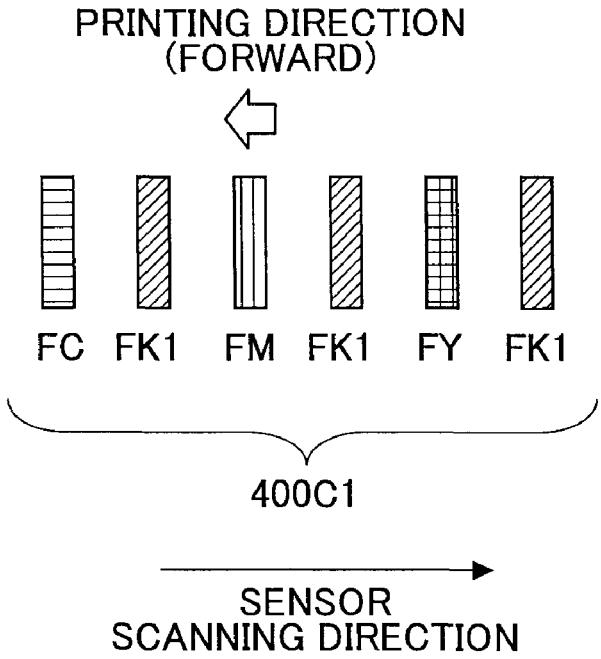
FIGS. 19A and 19B are diagrams explaining the adjustment pattern for adjusting a color shift.
Figure 19B:
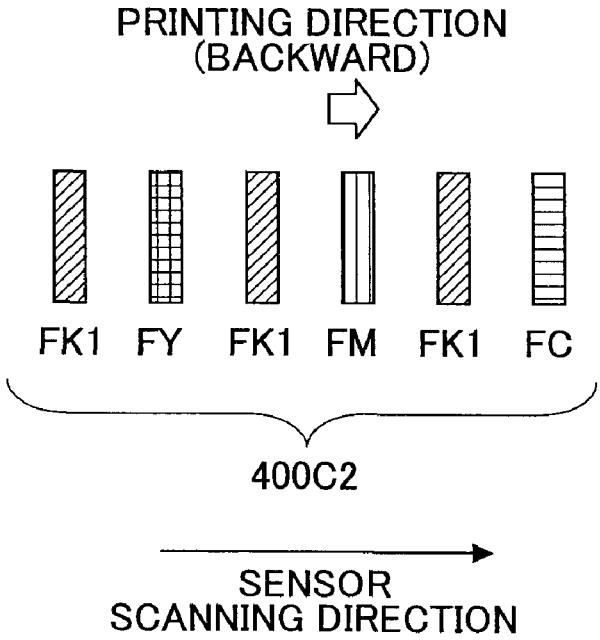

In the adjustment patterns 400C1 and 400C2 for adjusting the color shift shown in FIGS. 19A and 19B, the patterns FY, FM, and FC (i.e., patterns to be measured) in respective colors are printed relative to the reference color (here, the pattern FK1 formed by the recording head 24*k*1 is the reference pattern) at specific intervals. The shooting positions of the patterns FY, FM, and FC can be detected when their positions relative to the position of pattern FK1 are detected. Note that the sensor scanning direction refers to a case in which the patterns are scanned only in one direction.

Figure 20:
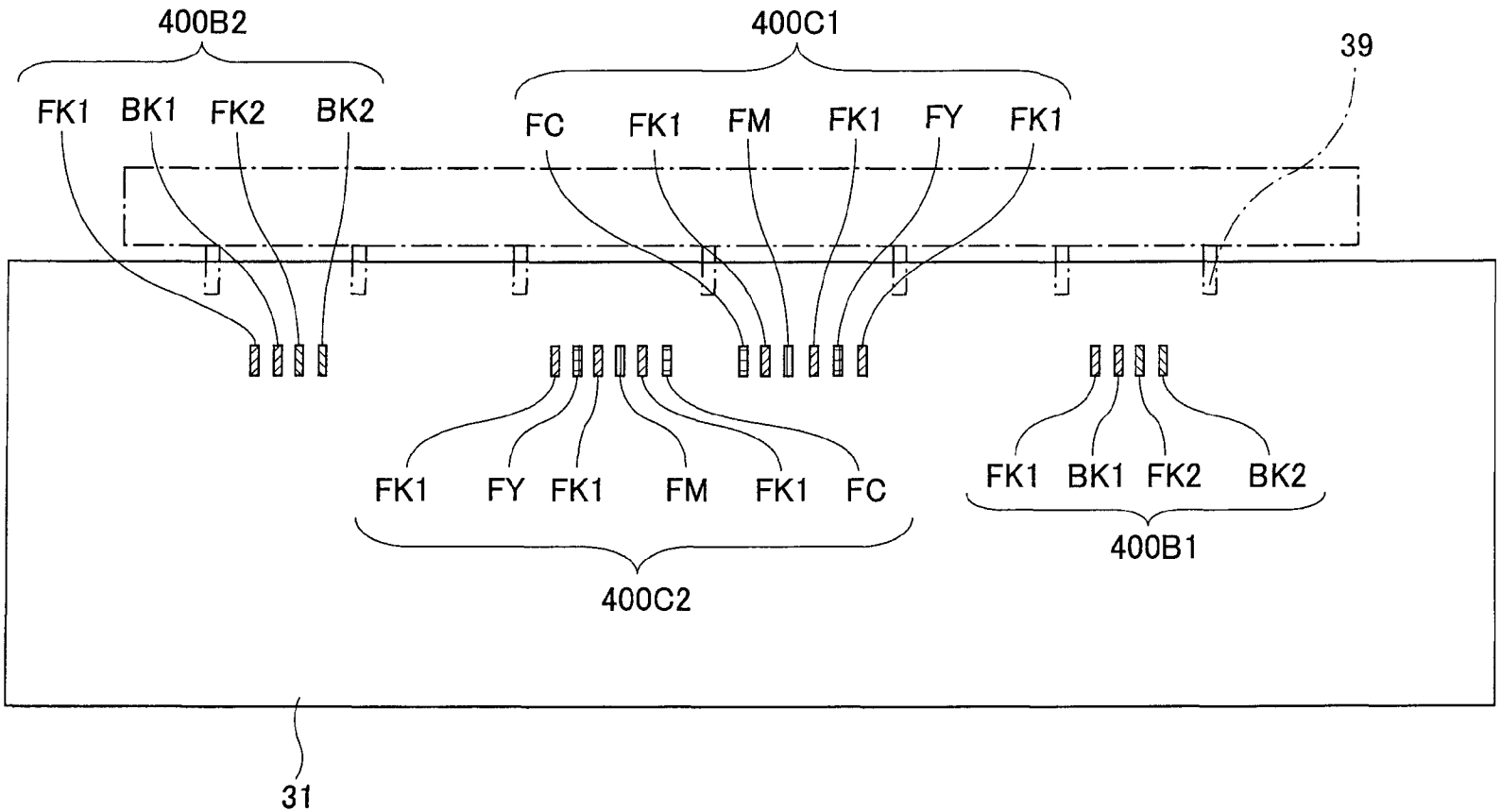
FIG. 20 is a diagram explaining the forming position of the adjustment pattern.

Next, referring to FIG. 20, a description is made of a specific example of forming the adjustment pattern.

First, in the scanning direction of the carriage 23, the direction from the rear surface side of the apparatus to its front surface side is a forward movement direction and the direction from the front surface side of the apparatus to its rear surface side is a backward movement direction. In addition, the recording heads 24*c*, 24*k*1, 24*k*2, 24*m*, and 24*y* are arranged in the carriage 23 in this order from the downstream side of the forward movement direction (front surface side of the apparatus).

In this example, adjustment patterns 400B1 and 400B2 for adjusting the deviation of ruled lines are formed one on each end side of the conveying belt 31, and adjustment patterns 400C1 and 400C2 for adjusting the color shift are formed at the central part of the conveying belt 31. In other words, in this example, the plural block patterns are arranged within the width of a printing area in a direction orthogonal to the feeding direction of the conveying belt 31. Note that because the block patterns are directly printed on the conveying belt 31, they are arranged in a part except for those having many irregularities on the surface of the conveying belt 31 (especially a part where the separating claw 39 for separating a medium to be recorded comes in contact with the conveying belt 31).

The pattern scanning sensor 401 scans each of the adjustment patterns 400B and 400C plural times. In this case, the pattern scanning sensor 401 can scan them plural times in one direction (same direction) or bi-directionally.

Figure 21:
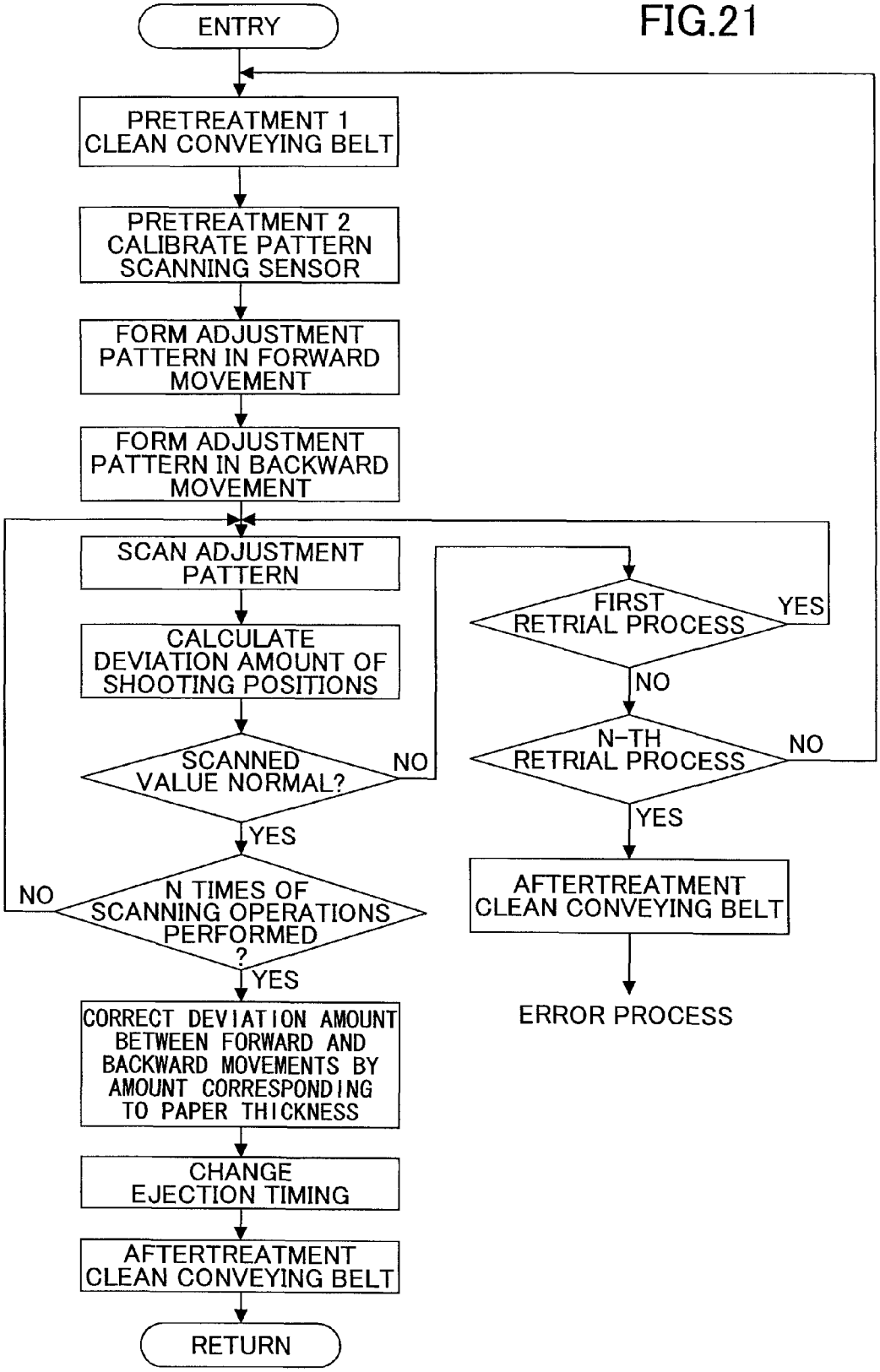
FIG. 21 is a flowchart of a process for correcting the deviation of shooting positions of liquid droplets.

Now, referring to the flowchart of FIG. 21, a description is made of a process for adjusting (correcting) the deviation of the shooting positions of liquid droplets executed by the main controlling section 310.

When this process is executed, cleaning of the conveying belt 31 is performed as a pretreatment 1, calibration of the pattern scanning sensor 401 is performed as a pretreatment 2, and the output of the light emitting element 402 is adjusted so that the output level of regular reflection light of the pattern scanning sensor 401 (light emitting element 402 and light receiving element 403) scanned by the carriage 23 becomes constant on the conveying belt 31.

Then, liquid droplets are ejected from the respective recording heads 24 while the carriage 23 is scanned forward in the main scanning direction, so that the patterns to be formed in the forward movement in the adjustment pattern 400 are formed. Subsequently, liquid droplets are ejected from the respective recording heads 24 while the carriage 23 is scanned backward, so that the patterns to be formed in the backward movement in the adjustment pattern 400 are formed.

After this, the carriage 23 is scanned forward in the main scanning direction with the light from the light emitting element 402 of the pattern scanning sensor 401 emitted so as to scan the adjustment pattern 400, and the shooting positions of the liquid droplets are detected based on the position of the adjustment pattern 400. Note that in this case, a deviation amount of shooting positions may be obtained based on a deviation amount relative to a regular distance in such a manner that the position of the adjustment pattern 400 is specified using an address (position information) by the linear encoder 129 that detects the position of the carriage 23. Alternatively, the deviation amount of shooting positions may be obtained based on the deviation amount relative to the regular distance in such a manner that a distance between the patterns is calculated based on time between the patterns and a carriage speed.

Then, it is determined whether the value scanned by the pattern scanning sensor 401 is normal. If the value is normal, it is determined whether N times of scanning operations are to be performed. If so, the process is returned to the scanning process. That is, the N times of scanning operations are repeatedly performed in the forward movement direction. When the N times of scanning operations are completed, the value for correcting liquid droplet ejection timing is calculated by correcting the deviation amount (reciprocating deviation amount) between the forward and backward movements of the carriage 23 by an amount corresponding to a paper thickness, thereby correcting print ejection timing based on the calculated liquid droplet ejection timing. After the correction of the print ejection timing, the front surface of the conveying belt 31 is cleaned as an aftertreatment.

If the value scanned by the pattern scanning sensor 401 is abnormal, it is determined whether this is the first retrial process. If so, the process is returned to the process for scanning the adjustment pattern 400 again. If not, it is determined whether this is the N-th retrial process. If not, the process is returned to the process for forming the adjustment pattern 400 again. If the frequency of the retrial process reaches is N times, the process goes forward to the process for cleaning the front surface of the conveying belt 31 as an aftertreatment. Then, the process goes forward to an error process.

As described above, the adjustment pattern has the reference pattern and the pattern to be measured that are composed of the plural independent liquid droplets and the block patterns for each minimum item for detecting the deviation of shooting positions on the water-repellent conveying belt as a pattern forming member. Then, light is irradiated on the respective patterns and the regular reflection light is received from the patterns so as to scan the patterns. Based on the scanned result, the deviation amount of shooting positions is found to correct the shooting positions of liquid droplets ejected from the recording head. Accordingly, it is possible to detect the shooting positions of liquid droplets with a simple configuration with high accuracy and correct the deviation of the shooting positions of liquid droplets with high accuracy.

Figure 22B:
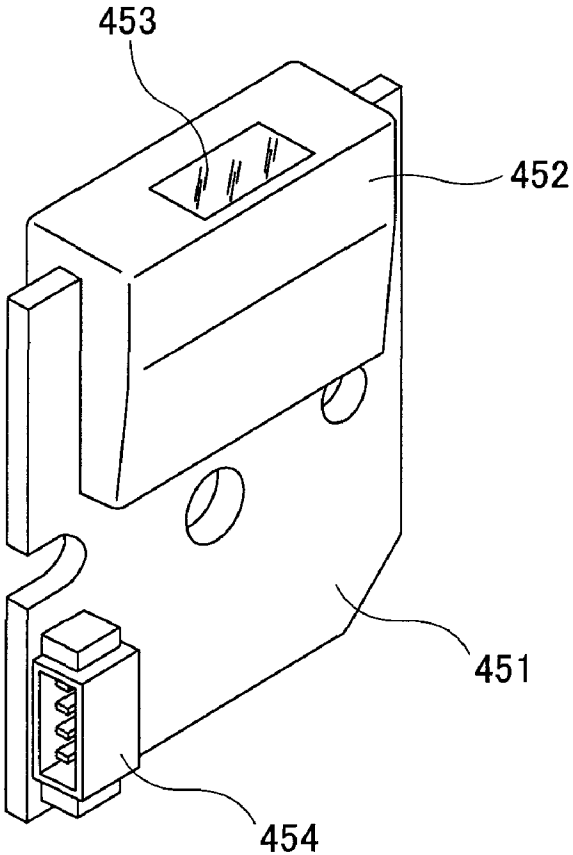
FIGS. 22A and 22B are perspective views of a sensor substrate showing a specific example of the pattern scanning sensor.
Figure 22A:
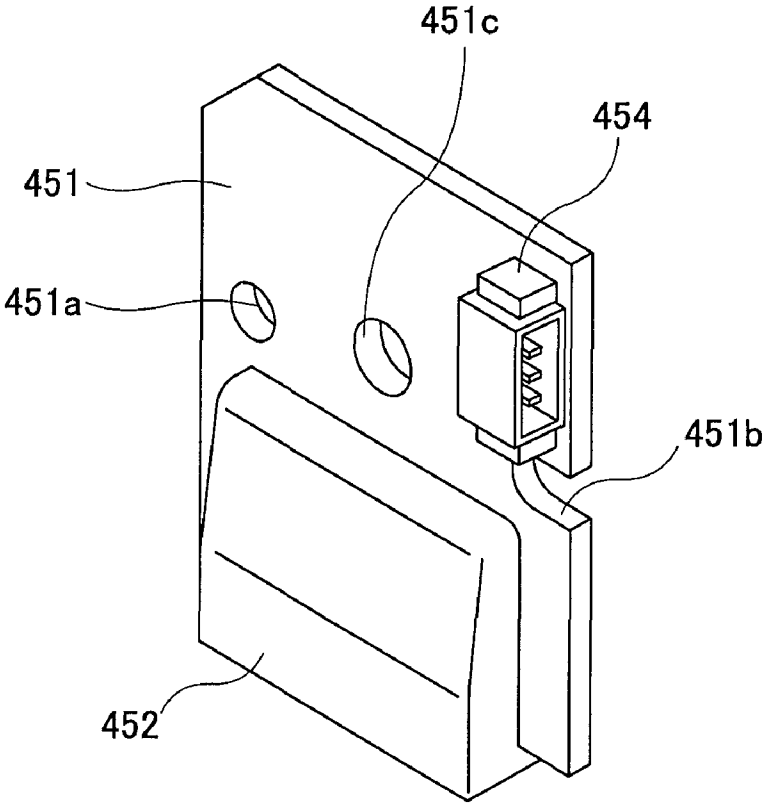

Next, referring to FIGS. 22A and 22B and the subsequent figures, a description is made of a structure of mounting the pattern scanning sensor 401 on the carriage 23 according to the embodiments of the present invention.

First, a specific configuration example of the pattern scanning sensor 401 (hereinafter referred to as the "reflective optical sensor 401") is described referring to FIGS. 22A, 22B, 23A, and 23B. Note that FIGS. 22A and 22B and FIGS. 23A and 23B are perspective views of a sensor substrate and perspective views of the whole sensor, respectively.

As shown in FIGS. 22A and 22B, the reflective optical sensor 401 has a sensor substrate 451 as a plate-shaped holding member on which a LED as the light-emitting element 402 and a photo diode as the light-receiving element 403 are mounted, and it is covered with a sensor housing 452 so to block unnecessary natural light. The sensor housing 452 is provided with a sensor lens 453 that allows emission light and incident light to pass through. In addition, the sensor substrate 451 has a connector 454 for electrical connection with the light-emitting element 402 and the light-receiving element 403.

Figure 23B:
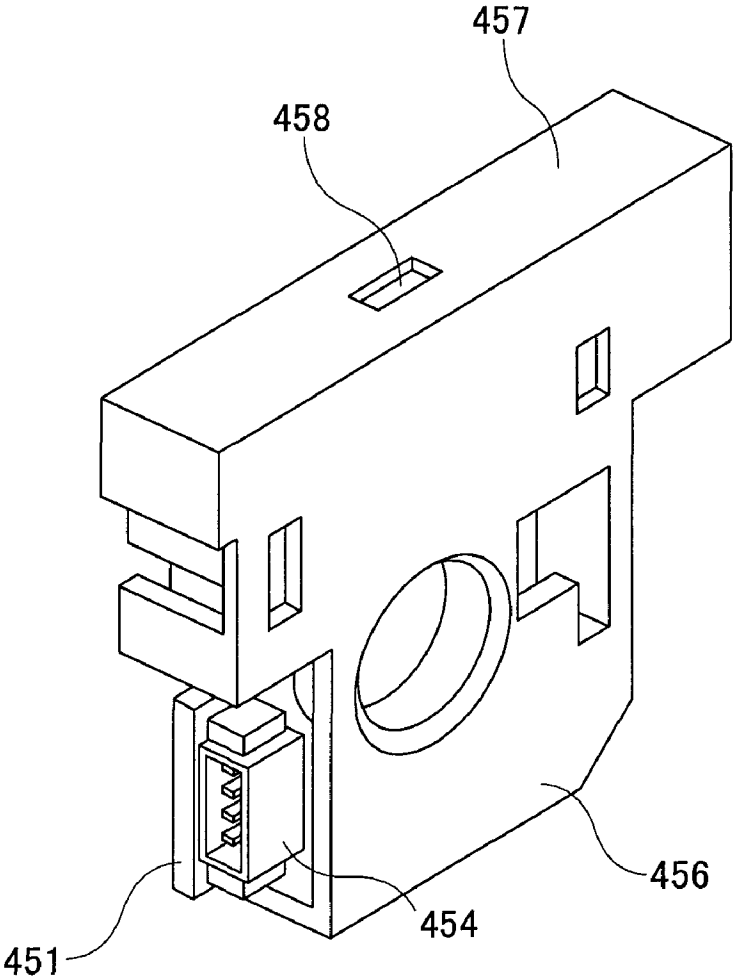
FIGS. 23A and 23B are perspective views of the pattern scanning sensor.
Figure 23A:
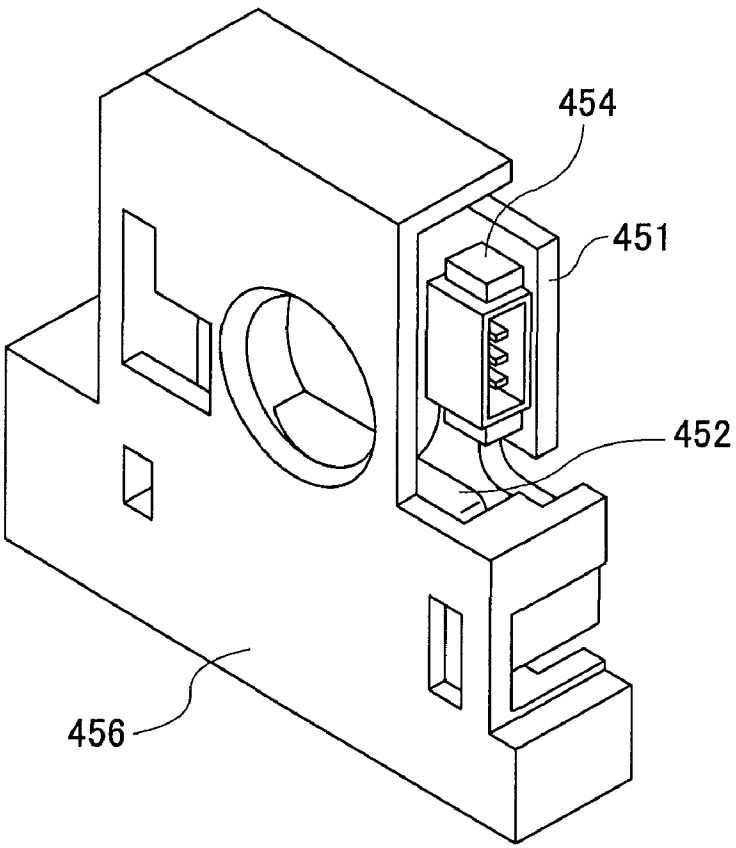

As shown in FIGS. 23A and 23B, a sensor cover 456 is attached to the sensor substrate 451 so as to cover the same. The side of the sensor lens 453 of the sensor cover 456 serves as a flat cap contact surface 457 where the cap 122 of the maintenance and recovery mechanism 121 can make contact. Moreover, a hole 458 of the sensor cover 456 is formed only at a part corresponding to the sensor lens 453. Note that the sensor cover 456 is separately provided so as not to directly apply the pressing force of the cap 122 to the sensor housing 452. However, if the sensor housing 452 is configured to have sufficient strength, it can also serves as the sensor cover 456.

Figure 24:
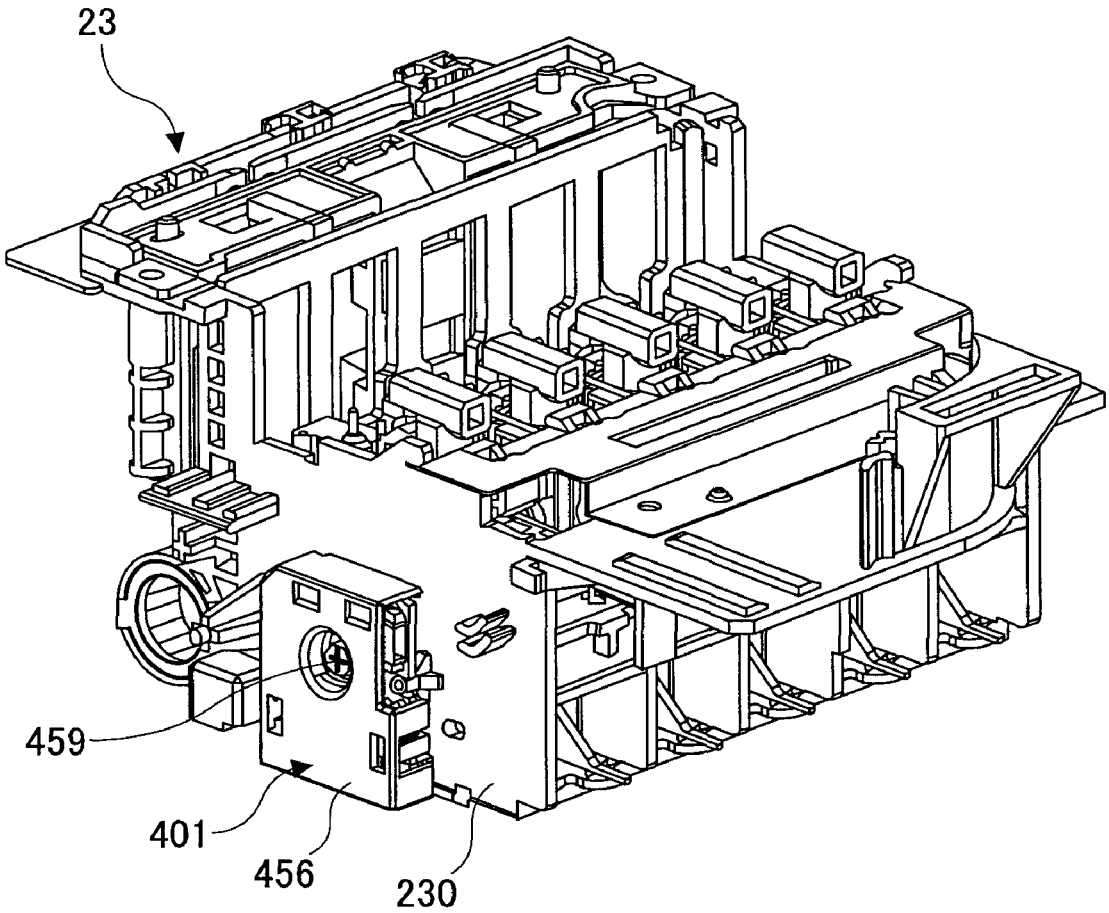
FIG. 24 is a perspective view of a carriage on which a sensor is mounted.
Figure 25:
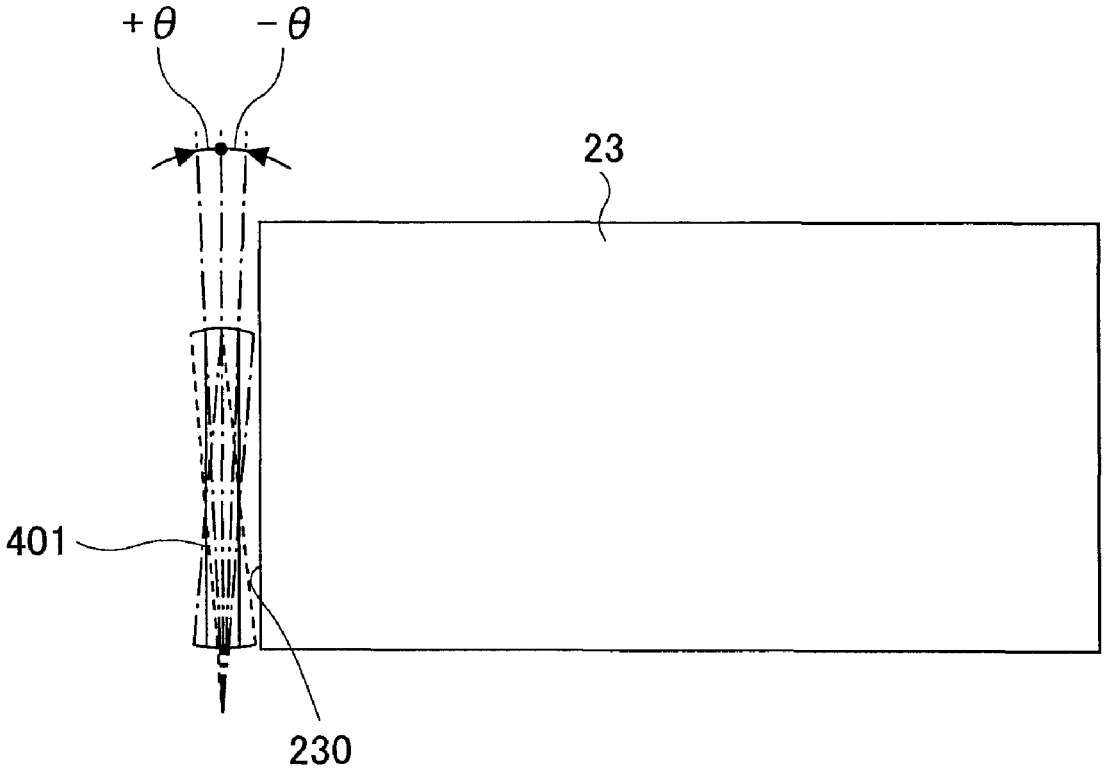
FIG. 25 is a diagram explaining the mounting angle of the sensor.
Figure 26:
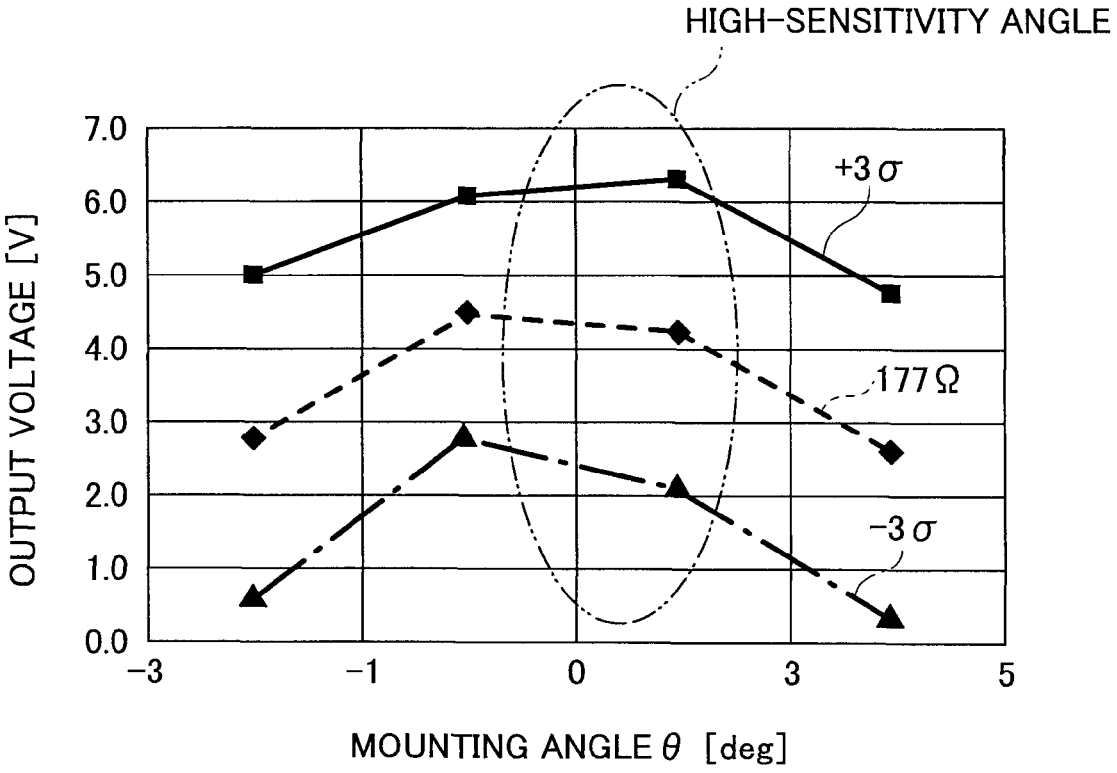
FIG. 26 is a graph of a relationship between the mounting angle of the sensor and an output voltage.

As shown in FIG. 24, the reflective optical sensor 401 is fixed to a side wall surface 230 of the carriage 23 in the main scanning direction by a clamping member 459. As shown in FIG. 25, a mounting angle θ of the reflective optical sensor 401 relative to the side wall surface 230 of the carriage 23 is zero at the position parallel to the side wall surface 230. FIG. 26 shows results obtained by evaluating a relationship between the mounting angle θ and a sensor output (output voltage) using a reflective photosensor having an input resistance of 177 Ω.

It is clear from FIG. 26 that the highest output voltage, i.e., the highest sensitivity can be obtained at the mounting angle θ of +1° through 2° in consideration of three standard deviations "3σ." In other words, higher detection sensitivity can be obtained when light is emitted to and received from the front surface of the conveying belt 31 at a slight angle rather than at a right angle relative to the conveying belt 31. Note that even when this optical reflective sensor is applied to a color-shift adjusting device of an electrophotographic image forming apparatus so as to detect a "toner image," the same result is obtained. That is, it turns out that higher sensitivity can be obtained when light is emitted to and received from a detection surface at an angle slightly inclined relative to the detection surface.

Figure 27:
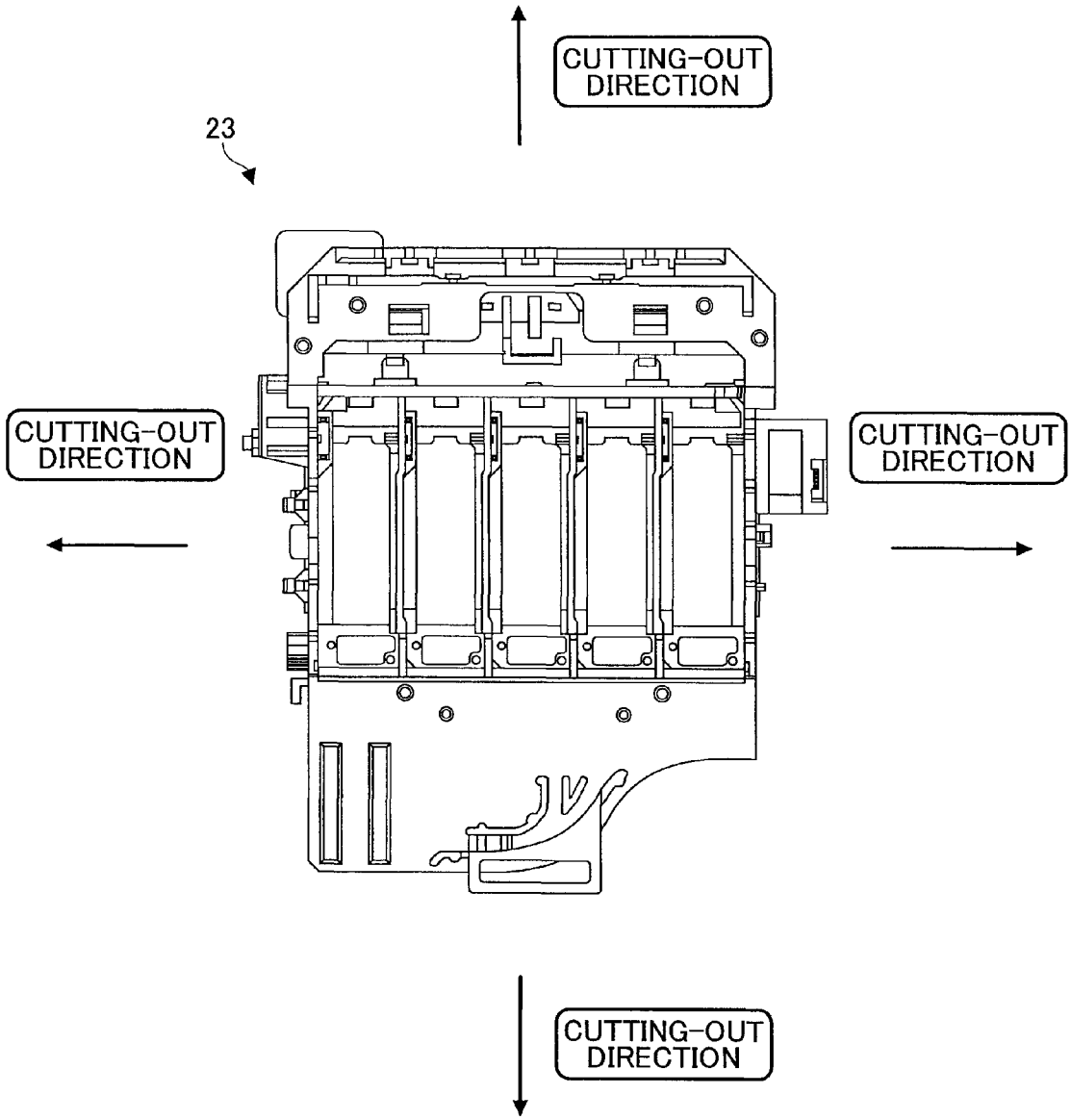
FIG. 27 is a plan view explaining the cutting-out of the carriage at the time of injection molding.
Figure 28:
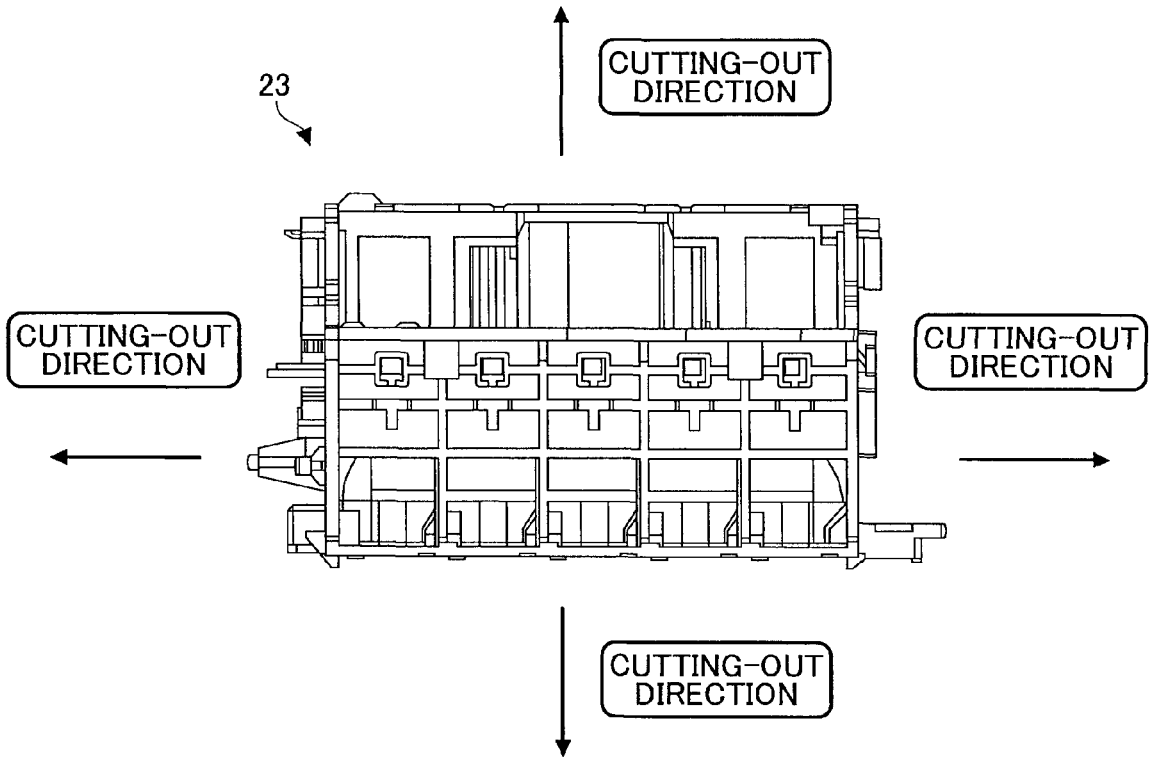
FIG. 28 is a front view explaining the cutting-out of the carriage at the time of injection molding.

On the other hand, the carriage 23 is fabricated by injection molding using resin. As shown in FIGS. 27 and 28, the cutting-out direction of the carriage 23 is generally perpendicular to the carriage 23 so as to improve the alignment accuracy of the mold, and by extension the accuracy of components. Here, in order to place high priority on the mounting angle of the reflective optical sensor 401, the carriage 23 can be configured to be inclined by the predetermined angle θ so as to be pulled out. In this case, however, other shapes, e.g., the tolerances of important dimensions, such as a bearing hole through which guide rod 21 passes and a slider sliding surface that determines the posture of the carriage 23, are increased.

Figure 29:
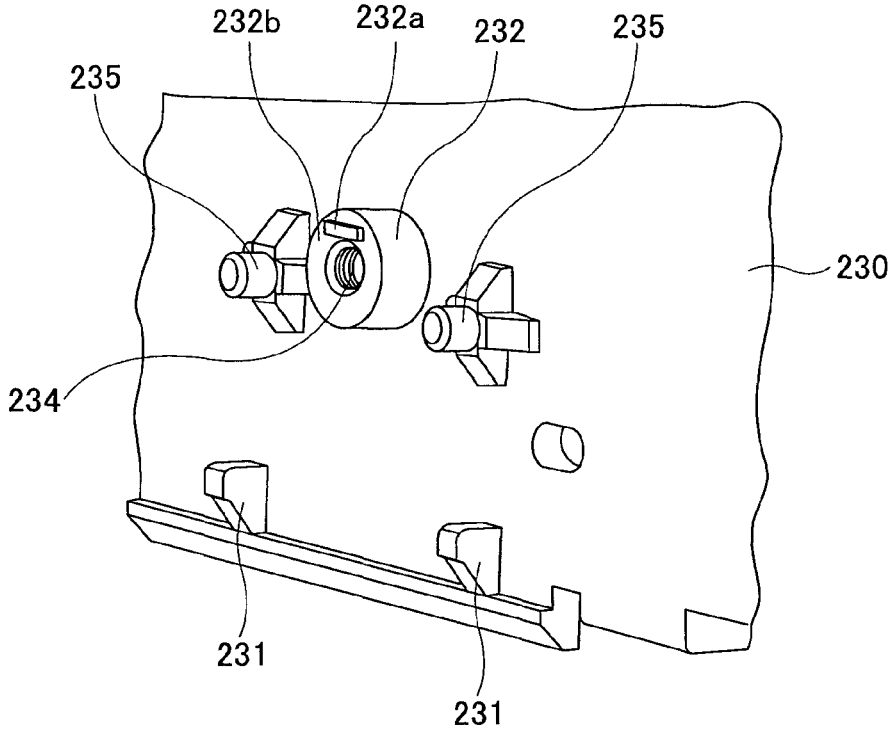
FIG. 29 is a perspective view of a substantial part of a side wall surface of the carriage for explaining the structure of the sensor according to a first embodiment of the present invention.

Now, referring to FIG. 29, a description is made of a structure of mounting the reflective optical sensor 401 according to a first embodiment of the present invention on the resin carriage 23, which is fabricated by injection molding, so as to be substantially parallel to (that refers to the sensor 401 being slightly inclined relative to) the side wall surface 230 of the carriage 23. Note that FIG. 29 is a perspective view of a substantial part of the side wall surface 230 of the carriage 23 for explaining the structure of the sensor 401.

The side wall surface 230 of the carriage 23 is provided with two first projection parts 231 and a second projection part 232 that define the inclination of the reflective optical sensor 401 in its vertical direction. The first projection parts 231 are provided at the same height position with the detection surface as a reference, and the second projection part 232 is provided at a position higher than the first projection parts 231 with the detection surface as the reference. In other words, the two first projection parts 231 are provided on the lower side (i.e., on the side of the conveying belt 31 or on the side of a head nozzle surface) of the side wall surface 230 of the carriage 23, and the second projection part 232 is provided on the upper side thereof. The first projection parts 231 and the second projection part 232 are arranged so as to form a triangle the topmost part of which is constituted by the second projection part when viewed from an outer side to the side wall surface 230.

Here, the heights of the first projection parts 231 (i.e., the heights of the first projection parts 231 from the side wall surface 230 of the carriage 23) are the same. Therefore, the light path (line from light emission to light reception) of the reflective optical sensor 401 is kept parallel to the recording head 24 fixed inside the carriage 23. Furthermore, the second projection part 232 has a first part 232*a* higher in position from the side wall surface 230 of the carriage 23 than the first projection parts 231 and has a second part 232*b* lower in position than the first part 232*a*. The second part 232*b* has a screw hole 234 into which the clamping member (screw) 459 for fixing the reflective optical sensor 401 to the second part 232*b* is tightened.

The screw 459 is tightened into the screw hole 234 provided in the second projection part 232 via a through-hole 451*c* (see FIG. 22A) of the sensor substrate 451 when the sensor substrate 451 of the reflective optical sensor 401 is in contact with the three points of the first and second projection parts 231 and 232. Accordingly, the sensor substrate 451 having the reflective optical sensor 401 mounted thereon is fixed and attached to the side wall surface 230 of the carriage 23 so as to be slightly inclined.

Note that the side wall surface 230 of the carriage 23 is provided with two boss parts 235 that guide the positioning of the sensor substrate 451. The sensor substrate 451 of the reflective optical sensor 401 has a positioning hole 451*a* (see FIG. 22A) that fits in one boss part 235 and a notch part 451*b* that engages with the other boss part 235. With the positioning hole 451*a* and the notch part 451*b*, the positioning of the sensor substrate 451 is achieved.

As described above, the side wall surface 230 of the carriage 23 is provided with the at least two first projection parts 231 and the second projection part 232 that define the inclination of the optical sensor 401 in its vertical direction. The at least two first projection parts 231 are arranged at the same height position with the conveying surface of a medium to be recorded as the reference, and the second projection part 232 is arranged at a position higher than the first projection parts 231. The second projection part 232 has the first part 232*a* higher in position from the side wall surface 230 of the carriage 23 than the first projection parts 231 and has the second part 232*b* lower in position than the first part 232*a*. Moreover, the second part 232*b* has the screw hole 234 into which the clamping member 459 for fixing the optical sensor 401 to the second part 232*b* is tightened. Accordingly, with a simple configuration, it is possible to mount the reflective optical sensor 401 on the side wall surface 230 of the carriage 23, which is formed by injection molding using resin, so as to be slightly inclined relative to a direction perpendicular to the detection surface.

Figure 30:
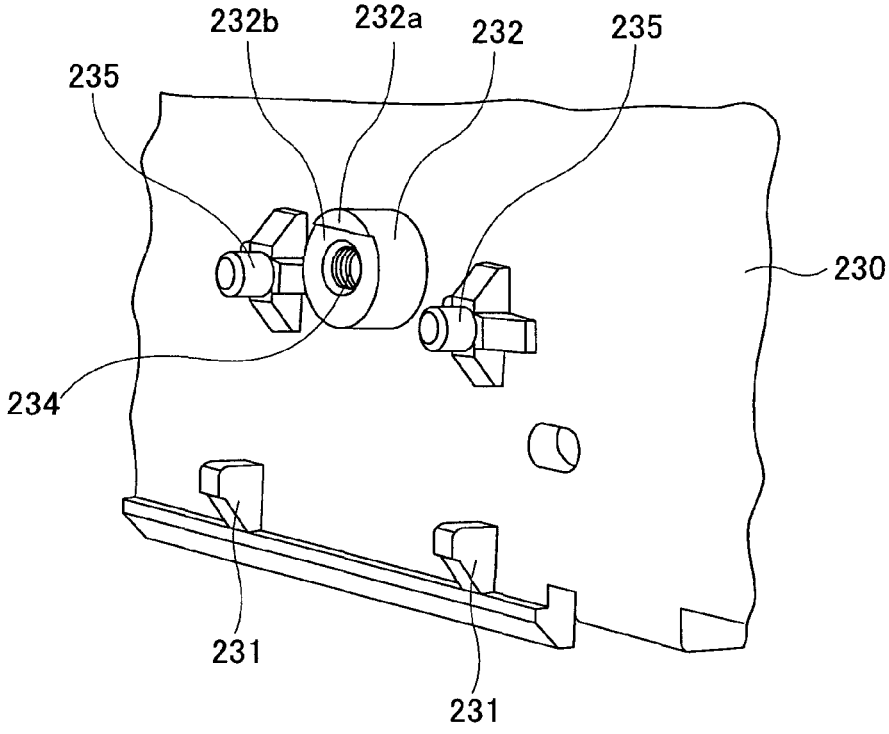
FIG. 30 is a side view of a substantial part of the side wall surface of the carriage for explaining the structure of the sensor according to a second embodiment of the present invention.
Figure 31:
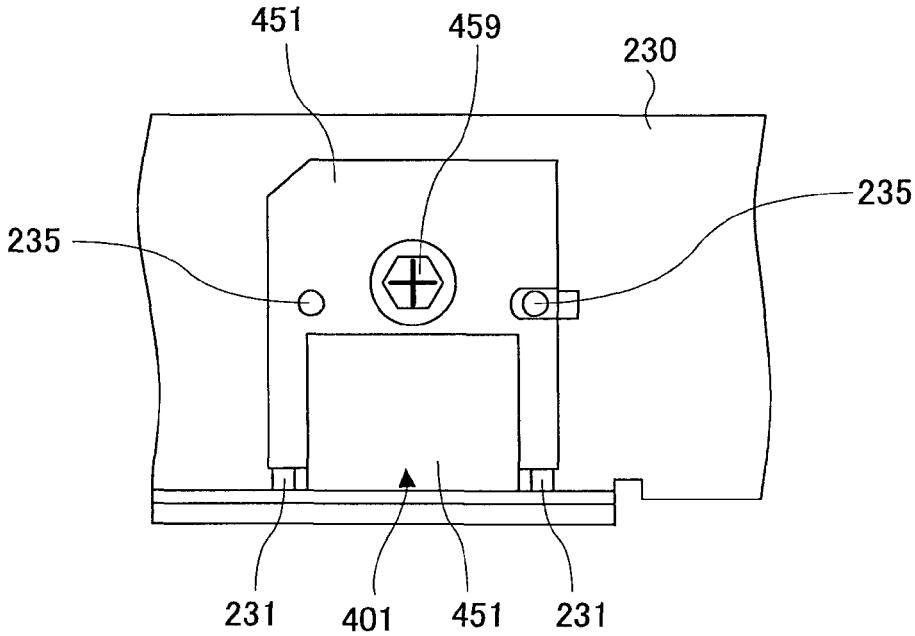
FIG. 31 is a side view of the side wall surface of the carriage to which a sensor substrate is attached.
Figure 32:
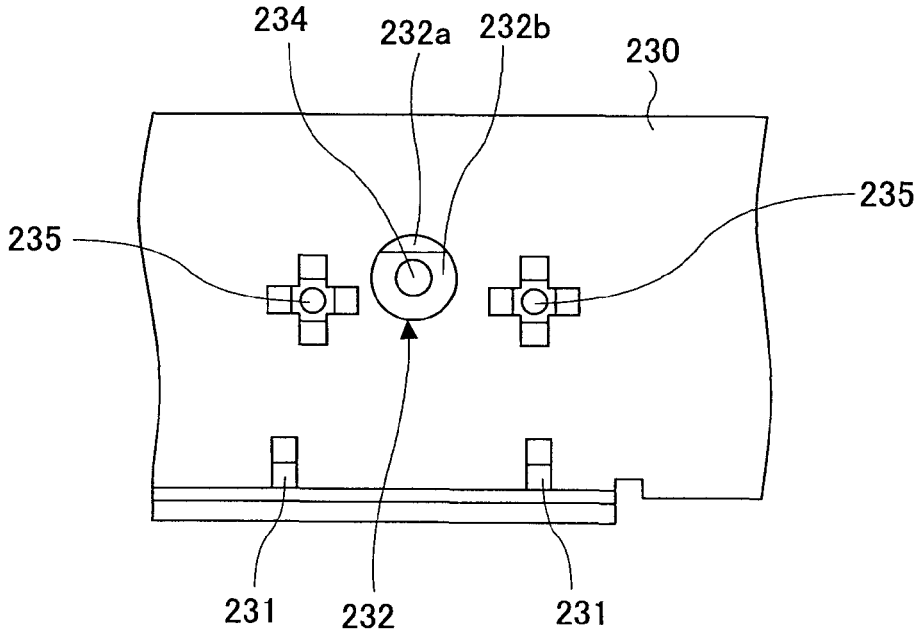
FIG. 32 is the side view of the side wall surface of the carriage to which the sensor substrate is not attached.

Next, referring to FIGS. 30 through 32, a description is made of a structure of mounting the sensor 401 according to a second embodiment of the present invention. Note that FIG. 30 is a perspective view of a substantial part of the side wall surface 230 of the carriage 23 for explaining the structure of the sensor 401, FIG. 31 is a side view of the side wall surface 230 of the carriage 23 to which the sensor substrate 451 is attached for explaining the structure of the sensor 401, and FIG. 32 is a side view of the side wall surface 230 when the sensor substrate 451 is not attached.

In this embodiment, the first part 232*a* of the second projection part 232 is shaped like an arch composed of a string and an arc. Even if the first part 232 is configured in this manner, the same effect as that of the first embodiment can be obtained.

Furthermore, the second projection part 232 is provided at a position at which distances from the two first projection parts 231 are equal. Accordingly, the pressing force of the sensor substrate 451 generated when the screw 249 is tightened into the second projection part 232 can be made uniform, and the deflection of the sensor substrate 451 can be reduced. As a result, sensor fixing accuracy is further improved.

Furthermore, with the provision of the screw hole 234 in the second projection part 232, a part far from the sensor part 452 of the sensor substrate 451 of the reflective optical sensor 401 can be fixed to the second projection part 232. Accordingly, the influence caused by the deflection of the sensor substrate 451 when the screw 249 is tightened hardly reaches the sensor mounting part (sensor part 452). As a result, the sensor fixing accuracy is further improved.

Furthermore, the two first projection parts 231 are arranged so that both side parts of the sensor part 452 of the sensor substrate 451 come in respective contact with the first projection parts 231. Accordingly, the influence caused by the deflection of the sensor substrate 451 when the screw 249 is tightened hardly reaches the sensor mounting part (sensor part 452). As a result, the sensor fixing accuracy is further improved.

Figure 33:
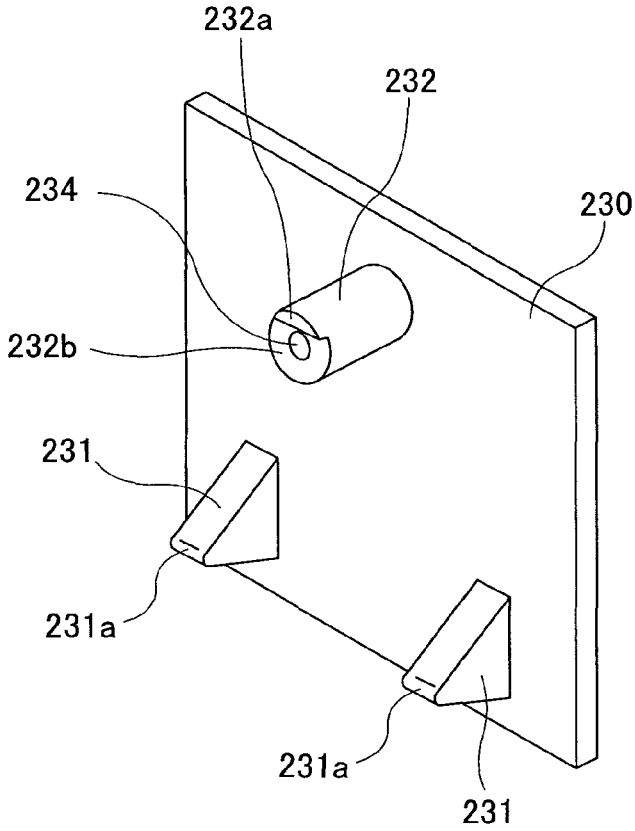
FIG. 33 is a side view of a substantial part of the side wall surface of the carriage for explaining the structure of the sensor according to a third embodiment of the present invention.

Next, referring to FIG. 33, a description is made of a structure of mounting the sensor 401 according to a third embodiment of the present invention. Note that FIG. 33 is a perspective view of a substantial part of the side wall surface 230 of the carriage 23 for explaining the structure of the sensor 401.

In this embodiment, as the first projection parts 231, ribs shaped like "R"s whose tip end parts 231*a* are come in contact with the sensor substrate 451 are used. In this case, the topmost points of the R-shapes come in line-contact with the sensor substrate 451. Accordingly, even if the screw 459 is tightened into the second projection part 232 to obliquely fix the sensor substrate 451, the sensor substrate 451 comes in contact with the apexes of the ribs 231. As a result, the sensor fixing accuracy is further improved.

Figure 34:
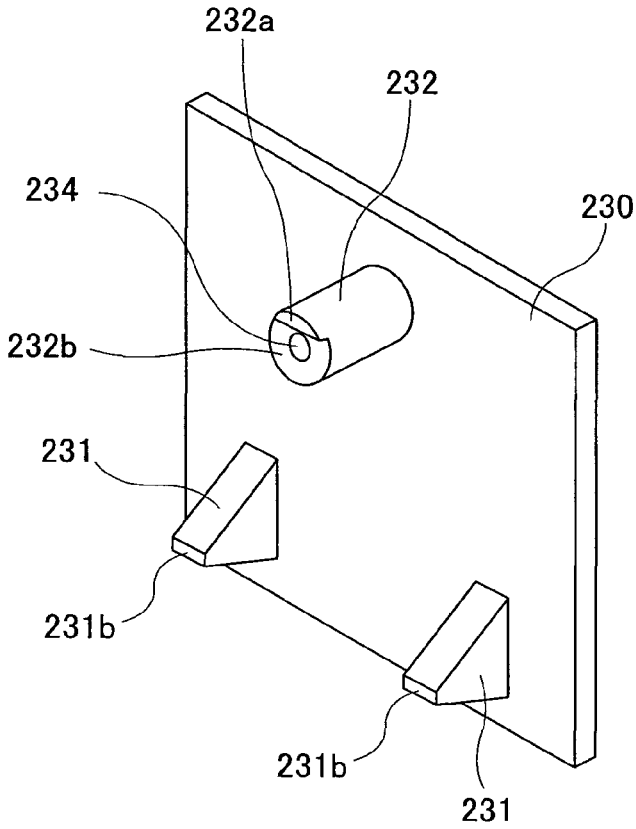
FIG. 34 is a side view of a substantial part of the side wall surface of the carriage for explaining the structure of the sensor according to a fourth embodiment of the present invention.

Next, referring to FIG. 34, a description is made of a structure for mounting the sensor 401 according to a fourth embodiment of the present invention. Note that FIG. 34 is a perspective view of a substantial part of the side wall surface 230 of the carriage 23 for explaining the structure of the sensor 401.

In this embodiment, as the first projection parts 231, ribs are used whose tip end parts 231*b* to come in contact with the sensor substrate 451 have small flat surfaces. This facilitates the inspection of the carriage 23.

Figure 35:
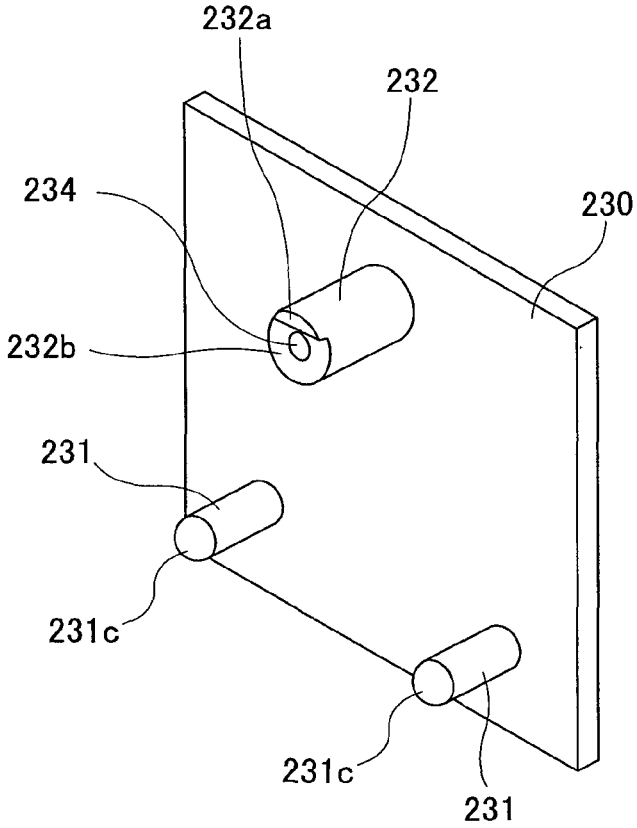
FIG. 35 is a side view of a substantial part of the side wall surface of the carriage for explaining the structure of the sensor according to a fifth embodiment of the present invention.

Next, referring to FIG. 35, a description is made of a structure of mounting the sensor 401 according to a fifth embodiment of the present invention. Note that FIG. 35 is a perspective view of a substantial part of the side wall surface 230 of the carriage 23 for explaining the structure of the sensor 401.

In this embodiment, as the first projection parts 231, cylindrical bosses (pins) are used whose tip end parts 231*c* to come in contact with the sensor substrate 451 are semispherical. In this case also, even if the screw 459 is tightened into the second projection part 232 to obliquely fix the sensor substrate 451, the sensor substrate 451 comes in contact with the apexes of the ribs. As a result, the sensor fixing accuracy is further improved. Furthermore, because it is possible to receive the sensor substrate 451 at two points, accuracy in the angle of the sensor substrate 451 is improved.

Figure 36:
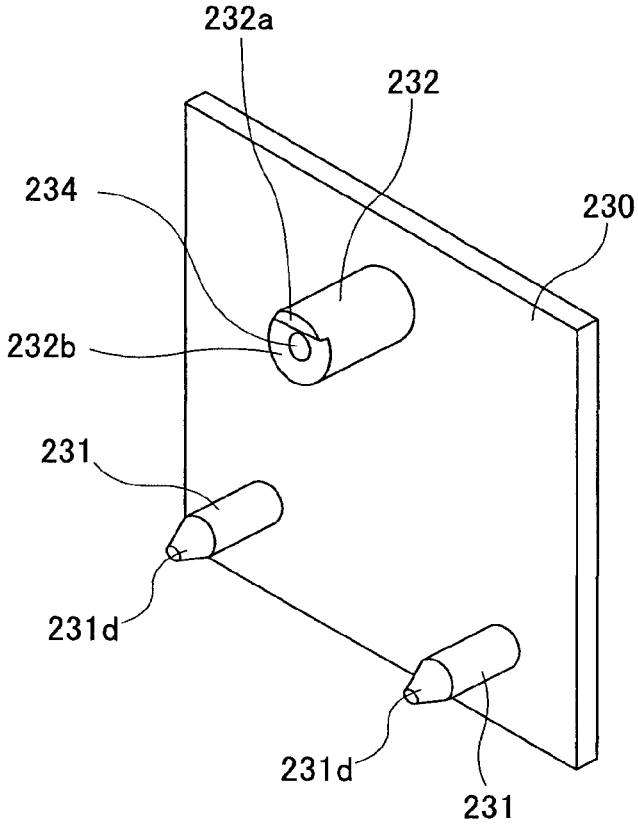
FIG. 36 is a side view of a substantial part of the side wall surface of the carriage for explaining the structure of the sensor according to a sixth embodiment of the present invention.

Next, referring to FIG. 36, a description is made of a structure of mounting the sensor 401 according to a sixth embodiment of the present invention. Note that FIG. 36 is a perspective view of a substantial part of the side wall surface 230 of the carriage 23 for explaining the structure of the sensor 401.

In this embodiment, as the first projection parts 231, cylindrical bosses (pins) are used whose tip end parts to come in contact with the sensor substrate 451 are tapered. In this case, through-holes having a diameter smaller than those of the bosses are provided in the sensor substrate 451, thereby making it possible to perform the positioning of the sensor substrate 451. This eliminates the necessity of providing a boss dedicated to the positioning of the sensor substrate 451 and attains the reduction of manufacturing costs. Furthermore, because there is no engagement backlash, accuracy in the position of the sensor substrate 451 can be improved.

Figure 37:
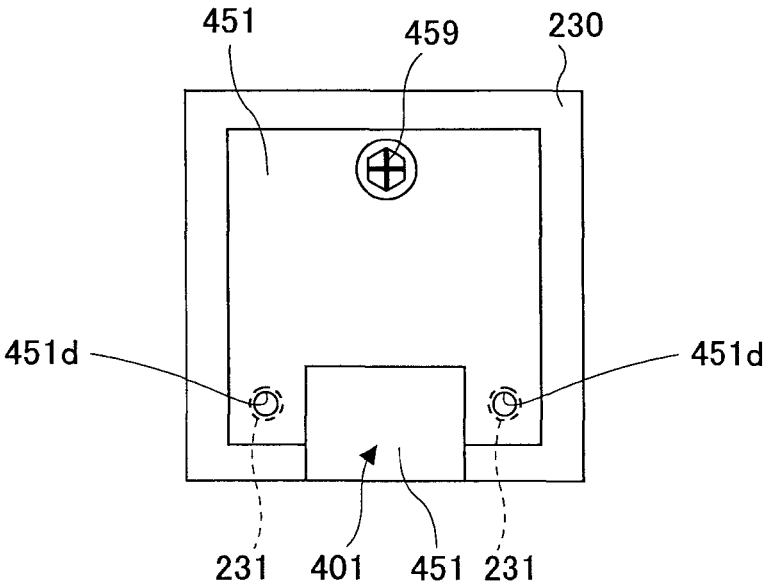
FIG. 37 is a front view of a substantial part of the side wall surface of the carriage for explaining the structure of the sensor according to a seventh embodiment of the present invention.
Figure 38:
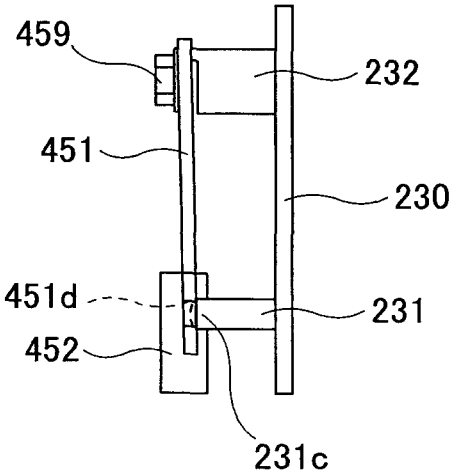
FIG. 38 is a side view of FIG. 37.

Next, referring to FIGS. 37 and 38, a description is made of a structure of mounting the sensor 401 according to a seventh embodiment of the present invention. Note that FIG. 37 is a front view of the side wall surface 230 of the carriage 23 for explaining the structure of the sensor 401 and FIG. 38 is a side view of FIG. 37.

In this embodiment, as the first projection parts 231, those having semispherical tip end parts 231*c* are used in the same manner as the fifth embodiment. Furthermore, through-holes 451*d* having a diameter smaller than those of the semispherical tip end parts 231*c* of the first projection parts 231 are provided in the sensor substrate 451. The tip end parts 231*c* of the first projection parts 231 partially fit in the through-holes 451*d* of the sensor substrate 451.

Accordingly, the positioning of the sensor substrate 451 can be accomplished, thereby eliminating the necessity of providing a boss dedicated to the positioning of the sensor substrate 451 and attaining the reduction of manufacturing costs. Furthermore, because there is no engagement backlash, accuracy in the position of the sensor substrate 451 can be improved.

Figure 39:
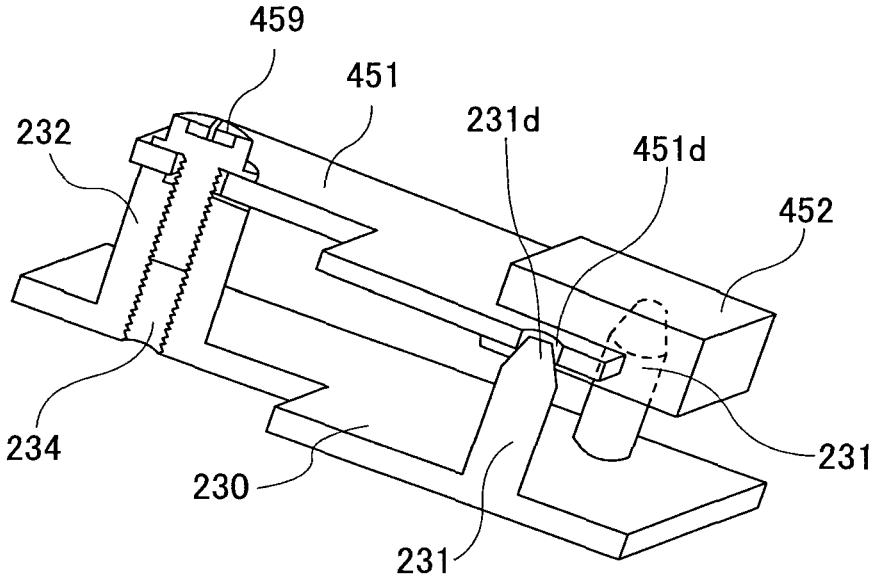
FIG. 39 is a perspective view of a substantial part of the side wall surface of the carriage for explaining the structure of the sensor according to an eighth embodiment of the present invention.

Next, referring to FIG. 39, a description is made of a structure of mounting the sensor 401 according to an eighth embodiment of the present invention. Note that FIG. 39 is a cut-away perspective view of the side wall surface 230 of the carriage 23 for explaining the structure of the sensor 401.

In this embodiment, as the first projection parts 231, those having a tapered tip end part 231*d* are used in the same manner as the sixth embodiment. Furthermore, the through-holes 451*d* having a diameter smaller than those of the bosses of the first projection parts 231 are provided in the sensor substrate 451. The tip end parts 231*c* of the first projection parts 231 partially fit in the through-holes 451*d* of the sensor substrate 451.

Accordingly, the positioning of the sensor substrate 451 can be accomplished, thereby eliminating the necessity of providing a boss dedicated to the positioning of the sensor substrate 451 and attaining the reduction of manufacturing costs. Furthermore, because there is no engagement backlash, accuracy in the position of the sensor substrate 451 can be improved.

Figure 40:
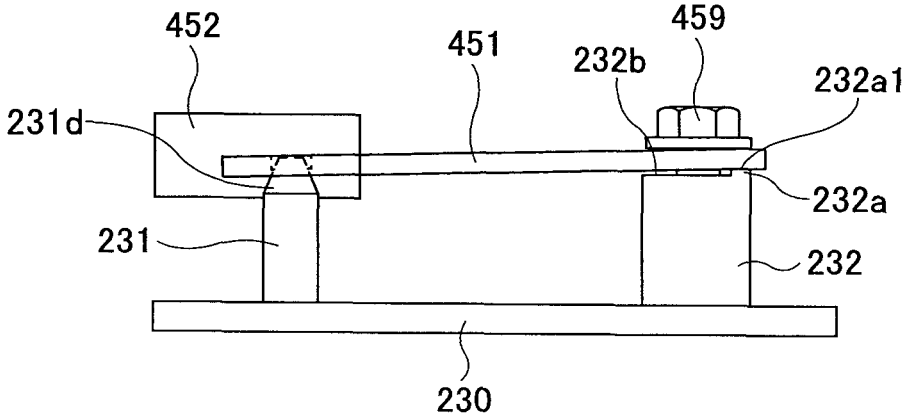
FIG. 40 is a side view of a substantial part of the side wall surface of the carriage for explaining the structure of the sensor according to a ninth embodiment of the present invention.
Figure 41:
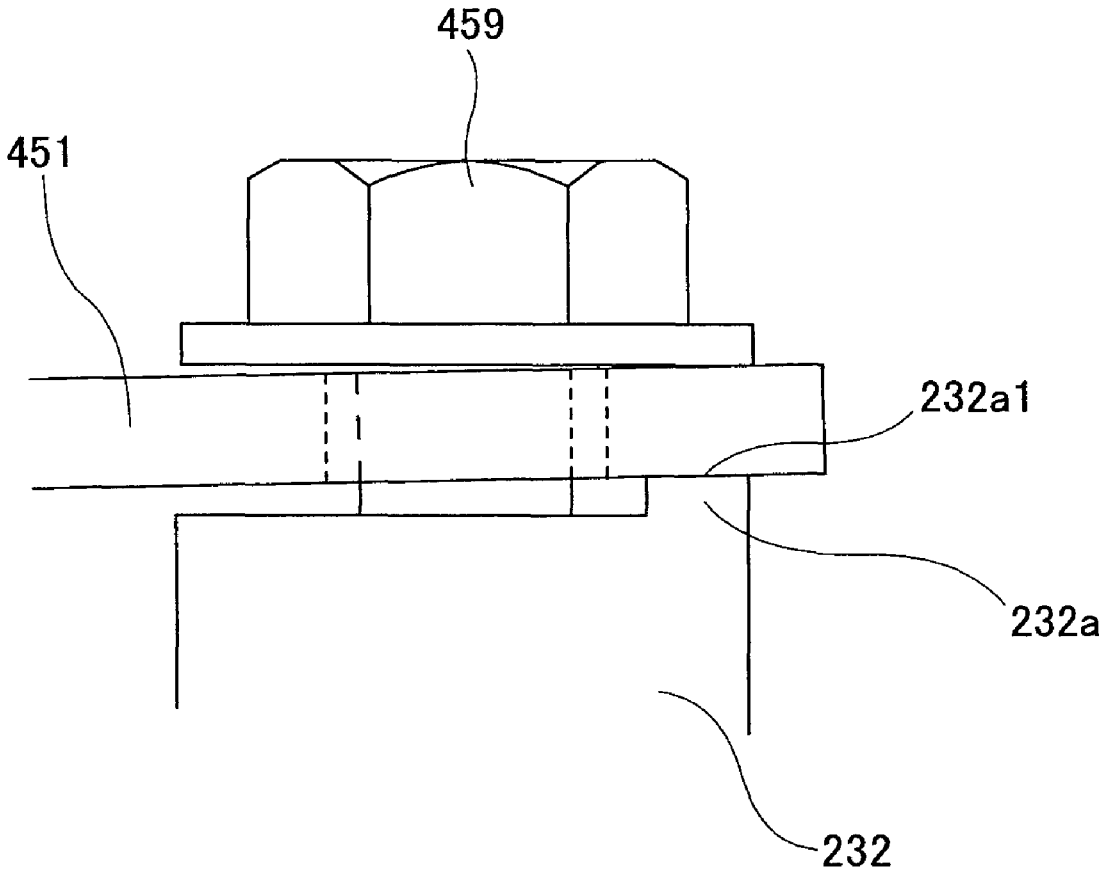
FIG. 41 is an enlarged side view of a part of the side wall surface of the carriage.

Next, referring to FIGS. 40 and 41, a description is made of a structure of mounting the sensor 401 according to a ninth embodiment of the present invention. Note that FIG. 40 is a side view for explaining the structure of the sensor 401 and FIG. 41 is an enlarged partial side view.

In this embodiment, a contact surface 232*a*1 of the first part 232*a* of the second projection part 232 to come in contact with the sensor substrate 451 is formed to be tapered rather than be parallel to the side wall surface 230 of the carriage 23. Accordingly, when the sensor substrate 451 is fixed to the second projection part 232, the sensitivity of the sensor 401 and its detection accuracy become greater than a case in which the sensor substrate 451 is obliquely attached to the side wall surface 230 of the carriage 23.

Note that the configuration for forming the patterns according to the above embodiments can be applied not only to the case using the conveying belt but also to a case using a water-repellent sheet material. Moreover, it can also be applied to a case in which the patterns are formed on a sheet material having no water-repellency and scanned by an optical sensor. In addition, it can also be applied to a structure of mounting an optical sensor that performs detection of the tip end of a medium to be recorded, besides the detection for the deviation of shooting positions of liquid droplets.

The present invention is not limited to the specifically disclosed embodiments, and variations and modifications may be made without departing from the scope of the present invention.

The present application is based on Japanese Priority Application No. 2007-314179 filed on Dec. 5, 2007, the entire contents of which are hereby incorporated herein by reference.

What is claimed is:

1. An image forming apparatus comprising:

a carriage that has installed therein an image forming section for forming an image on a medium to be recorded and is moved to scan; and an optical sensor that is mounted on a side wall surface of the carriage in a scanning direction thereof and detects one of the medium to be recorded and a conveying surface of the medium to be recorded; wherein the side wall surface of the carriage is provided with at least two first projection parts and a second projection part that define an inclination of the optical sensor in a vertical direction thereof, the at least two first projection parts are arranged at a same height position with the conveying surface of the medium to be recorded as a reference, and the second projection part is arranged at a position higher than the first projection parts, the second projection part having a first part higher in position from the side wall surface of the carriage than the first projection parts and having a second part lower in position than the first part, the second part having a screw hole in which a clamping member for fixing the optical sensor is attached.

2. The image forming apparatus according to claim 1, wherein the first part of the second projection part is shaped like an arch composed of a string and an arc, parallel to the side wall surface of the carriage, and provided at a position farther from the first projection parts than the screw hole.

3. The image forming apparatus according to claim 1, wherein distances from the second projection part to the first projection parts are equal.

4. The image forming apparatus according to claim 1, wherein the optical sensor has a plate-shaped holding member that supports a sensor part including a light-emitting section and a light-receiving section, the holding member having a part away from the sensor part at which the second projection part is fixed.

5. The image forming apparatus according to claim 4, wherein the sensor part supported by the holding member comes in contact with the first projection parts at both sensor member side parts.

6. The image forming apparatus according to claim 4, wherein the first projection parts with which the holding member comes in contact are shaped like one of "R"s and flat surfaces.

7. The image forming apparatus according to claim 4, wherein tip end parts of the first projection parts with which the holding member comes in contact are semispherical.

8. The image forming apparatus according to claim 4, wherein tip end parts of the first projection parts with which the holding member comes in contact are tapered.

9. The image forming apparatus according to claim 7, wherein the holding member has through-holes in which the tip end parts of the first projection parts partially fit.

10. The image forming apparatus according to claim 1, wherein the first part of the second projection part is tapered rather than be parallel to the side wall surface of the carriage and provided farther from the first projection parts than the screw hole.

11. A carriage that has installed therein an image forming section for forming an image on a medium to be recorded and is moved to scan, wherein a side wall surface of the carriage in a scanning direction thereof is provided with at least two first projection parts and a second projection part that define an inclination of an optical sensor in a vertical direction thereof, the optical sensor detecting one of a medium to be recorded and a conveying surface of the medium to be recorded, and the at least two first projection parts are arranged at a same height position with the conveying surface of the medium to be recorded as a reference and the second projection part is arranged at a position higher than the first projection parts, the second projection part having a first part higher in position from the side wall surface of the carriage than the first projection parts and having a second part lower in position than the first part, the second part having a screw hole in which a clamping member for fixing the optical sensor is attached.

* * * * *